US010878794B2

(12) United States Patent
Hakuta

(10) Patent No.: US 10,878,794 B2
(45) Date of Patent: Dec. 29, 2020

(54) SOUNDPROOFING STRUCTURE

(71) Applicant: FUJIFILM Corporation, Tokyo (JP)

(72) Inventor: Shinya Hakuta, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 34 days.

(21) Appl. No.: 16/423,330

(22) Filed: May 28, 2019

(65) Prior Publication Data

US 2019/0295522 A1 Sep. 26, 2019

Related U.S. Application Data

(63) Continuation of application No. PCT/JP2017/042199, filed on Nov. 24, 2017.

(30) Foreign Application Priority Data

Nov. 29, 2016 (JP) ..... 2016-231485

(51) Int. Cl.
*G10K 11/172* (2006.01)
*E04B 1/84* (2006.01)
(Continued)

(52) U.S. Cl.
CPC ..... *G10K 11/172* (2013.01); *E04B 1/84* (2013.01); *E04B 1/86* (2013.01); *G10K 11/16* (2013.01);
(Continued)

(58) Field of Classification Search
CPC .... G10K 11/16; G10K 11/162; G10K 11/172; G10K 11/175; G10K 11/20; E04B 1/86;
(Continued)

(56) References Cited

U.S. PATENT DOCUMENTS 5,587,564 A * 12/1996 Stief ..... G10K 11/172 181/286
5,740,649 A * 4/1998 Fuchs ..... E04B 1/86 52/144
(Continued)

FOREIGN PATENT DOCUMENTS

CN 101329864 A 12/2008
CN 101460993 A 6/2009
(Continued)

OTHER PUBLICATIONS

Min Yang et al., "Subwavelength total acoustic absorption with degenerate resonators", Applied Physics Letters, Sep. 11, 2015, 6 pages, vol. 107 (104194-1 to 104104-5).
(Continued)

*Primary Examiner* — Edgardo San Martin
(74) *Attorney, Agent, or Firm* — Sughrue Mion, PLLC

(57) ABSTRACT

A soundproof structure includes two or more different kinds of resonant type sound absorbing cells, and an opening part. The opening part is disposed in a position in contact with both two resonant type sound absorbing cells of the two or more different kinds of resonant type sound absorbing cells, or the two resonant type sound absorbing cells are adjacent to each other, and the opening part is disposed in a position adjacent to at least one of the two resonant type sound absorbing cells. Resonance frequencies of one kind of first resonant type sound absorbing cells and resonance frequencies of the other kind of second resonant type sound absorbing cells different from the first resonant type sound absorbing cells match each other. As a result, this soundproof structure can achieve an absorbance of more than 50%, preferably, close to 100% even in a compact, light, and thin structure which is much smaller than a wavelength, and can
(Continued)

achieve air permeability, heat conductivity, and a high soundproofing effect by providing a passage of air.

23 Claims, 12 Drawing Sheets

(51) Int. Cl.
*E04B 1/86* (2006.01)
*G10K 11/16* (2006.01)
*G10K 11/168* (2006.01)
*E04B 1/99* (2006.01)

(52) U.S. Cl.
CPC .... *G10K 11/168* (2013.01); *E04B 2001/8423* (2013.01)

(58) Field of Classification Search
CPC ..... E04B 1/99; E04B 1/84; E04B 2001/8423; E04B 2001/8442; E04B 2001/8452; E04B 2001/8476; E04B 2001/848; E04B 2001/8485; E04B 2001/8495; B60R 13/08
See application file for complete search history.

(56) References Cited

U.S. PATENT DOCUMENTS

| | | | | |
|---|---|---|---|---|
| 6,082,489 | A * | 7/2000 | Iwao | G10K 11/172 181/286 |
| 6,516,849 | B2 * | 2/2003 | Flament | B60C 17/04 152/400 |
| 6,799,657 | B2 * | 10/2004 | Daniels | F04B 53/002 181/175 |
| 8,011,472 | B2 * | 9/2011 | Tanase | G10K 11/172 181/286 |
| 8,360,201 | B2 * | 1/2013 | Tanase | G10K 11/172 181/291 |
| 10,373,599 | B2 * | 8/2019 | Hakuta | G10K 11/161 |
| 10,676,919 | B2 * | 6/2020 | Yamazoe | E04B 1/8209 |
| 10,704,255 | B2 * | 7/2020 | Hakuta | E04B 1/86 |
| 2005/0194209 | A1 * | 9/2005 | Yang | G10K 11/172 181/286 |
| 2009/0223738 | A1 * | 9/2009 | Nakamura | G10K 11/172 181/175 |
| 2009/0283356 | A1 | 11/2009 | Tsugihashi et al. | |
| 2010/0212999 | A1 * | 8/2010 | Marion | G10K 11/172 181/250 |
| 2012/0240486 | A1 | 9/2012 | Borroni | |
| 2016/0071507 | A1 * | 3/2016 | Kim | E01F 8/0005 181/286 |
| 2016/0104472 | A1 | 4/2016 | Sheng et al. | |
| 2017/0341186 | A1 | 11/2017 | Hakuta et al. | |
| 2018/0082668 | A1 * | 3/2018 | Yamazoe | G10K 11/16 |
| 2018/0286371 | A1 * | 10/2018 | Davis | G01N 29/11 |
| 2019/0038471 | A1 * | 2/2019 | Naya | A61F 11/14 |
| 2019/0080676 | A1 * | 3/2019 | Kim | G10K 11/162 |
| 2019/0186126 | A1 * | 6/2019 | Ohtsu | G10K 11/172 |
| 2020/0143784 | A1 * | 5/2020 | Huang | E04F 13/075 |

FOREIGN PATENT DOCUMENTS

| | | | | | |
|---|---|---|---|---|---|
| CN | 101499273 | A | | 8/2009 | |
| CN | 102639795 | A | | 8/2012 | |
| CN | 105637580 | A | | 6/2016 | |
| DE | 4409200 | C2 | * | 6/1996 | B62D 25/082 |
| JP | 61-106296 | U | | 7/1986 | |
| JP | 7-175485 | A | | 7/1995 | |
| JP | 8-30277 | A | | 2/1996 | |
| JP | 08050489 | A | * | 2/1996 | |
| JP | 11015476 | A | * | 1/1999 | |
| JP | 2005-266399 | A | | 9/2005 | |
| JP | 2009-139556 | A | | 6/2009 | |
| JP | 2009139555 | A | * | 6/2009 | |
| JP | 2009-145740 | A | | 7/2009 | |
| JP | 4832245 | B2 | | 12/2011 | |
| JP | 2012071662 | A | * | 4/2012 | |
| JP | 2014-240975 | A | | 12/2014 | |
| JP | 2016-164642 | A | | 9/2016 | |
| WO | 2016/136973 | A1 | | 9/2016 | |
| WO | WO-2019181614 | A1 | * | 9/2019 | G10K 11/16 |
| WO | WO-2019208132 | A1 | * | 10/2019 | G10K 11/172 |

OTHER PUBLICATIONS

International Search Report for PCT/JP2017/042199 dated Feb. 13, 2018 [PCT/ISA/210].
Written Opinion for PCT/JP2017/042199 dated Feb. 13, 2018 [PCT/ISA/237].
Communication issued Dec. 9, 2019 by the State Intellectual Property Office of P.R of China in application No. 201780073585.1 .
Communication dated Nov. 15, 2019, from the European Patent Office in counterpart European Application No. 17877256.2.
International Preliminary Report on Patentability dated Jun. 4, 2019 from the International Bureau in counterpart International Application No. PCT/JP2017/042199.
Communication issued Jul. 9, 2019, by the Japanese Patent Office in Application No. 2018-553819.
Office Action dated Sep. 18, 2020 from European Patent Office in EP Application No. 17877256.2.

* cited by examiner

SOUNDPROOFING STRUCTURE

CROSS-REFERENCE TO RELATED APPLICATIONS

This application is a Continuation of PCT International Application No. PCT/JP2017/042199 filed on Nov. 24, 2017, which claims priority under 35 U.S.C. § 119(a) to Japanese Patent Application No. 2016-231485 filed on Nov. 29, 2016. The above application is hereby expressly incorporated by reference, in its entirety, into the present application.

BACKGROUND OF THE INVENTION

1. Field of the Invention

The present invention relates to a soundproof structure, and particularly, relates to a soundproof structure capable of achieving all a high absorbance of sound and air permeability and heat conductivity by using two or more kinds of resonant type sound absorbing cells.

2. Description of the Related Art

Since the heavier the mass of a general sound insulation material of the related art, the better the sound is shielded, the sound insulation material itself becomes large and heavy in order to obtain a favorable sound insulation effect. Meanwhile, it is difficult to shield sound having a low-frequency component in particular. In general, in a case where this region is called the mass law and the frequency has doubled, it has been known that the shielding is increased by 6 dB.

As stated above, since most soundproof structures of the related art have performed sound insulation with the mass of the structure, there is a disadvantage that the soundproof structure becomes large and heavy and it is difficult to perform low-frequency shielding.

Thus, there is a need for a light and thin sound insulation structure as a sound insulation material corresponding to various fields such as devices, automobiles, and general households. Therefore, a sound insulation structure which attaches a frame to a thin and light film structure and controls vibration of a film has gathered attention (see JP4832245B and JP2009-139556A).

In the case of this structure, since the principle of the sound insulation follows the stiffness law different from the mass law, it is possible to further shield a low-frequency component even in a thin structure. This region is called the stiffness law, and behaves similarly in a case where the film has a finite size matched with a size of a frame opening due to the fixation of film vibration in a frame portion.

JP4832245B discloses a sound absorbing body that has a frame body which has a through-hole formed therein and a plate-shaped or film-shape sound absorbing material which covers one opening of the through-hole. Two storage modulus of the sound absorbing material are respectively in predetermined ranges (see Abstract, Claim 1, Paragraphs [0005] to [0007] and [0034], and the like).

The sound absorbing body disclosed in JP4832245B is used in a state in which the other surface of the frame body adheres to and is fixed to a processed surface so that the other opening of the through-hole of the frame body is closed and a rear air layer is formed between the sound absorbing material which covers the one opening surrounded by the frame body and the processed surface.

In JP4832245B, both a sound absorption frequency and an absorption rate are correlated with a thickness of the rear air layer (a thickness of the frame body) and a diameter of the through-hole of the frame body. As the thickness becomes thicker and the diameter becomes larger, the sound absorption frequency is decreased, and the absorption rate is increased. Thus, the sound absorbing body disclosed in JP4832245B can achieve an advanced sound absorption effect in the low-frequency region without increasing the size thereof.

JP2009-139556A discloses a sound absorbing body which is covered with a film material (film-shaped sound absorbing material) that covers a cavity opening part which is partitioned by a partition wall as a frame and is closed by a posterior wall (stiff wall) using a plate-shaped member so that a front portion forms an opening part. A pressing plate is placed on the film material. In the sound absorbing body, a resonance hole for a Helmholtz resonance is formed in a region (corner portion) within a range of 20% of a dimension of a surface of the film-shaped sound absorbing material from a fixed end of a peripheral portion of the opening part which is a region in which displacement due to sound waves of the film material is least likely to be caused. In the sound absorbing body, the cavity is blocked except for the resonance hole. This sound absorbing body performs a sound absorbing action by film vibration and a sound absorbing action by a Helmholtz resonance.

Subwavelength total acoustic absorption with degenerate resonators, Min Yang et. al., Applied Physics Letters 107, 104104 (2015) discloses two degenerated complete composite sound absorbing bodies in which monopole and dipole resonators are combined.

A first sound absorbing body is a square flat panel that includes a single decorated membrane resonator (DMR) for the dipole resonator and a pair of coupled DMRs for the monopole resonator. Here, the coupled DMRs are obtained by bonding a rubber film with a weight to the center so as to cover openings at both ends of a large-diameter short circular pipe provided in the center of the panel. The single DMR is obtained by bonding a rubber film with a weight to the center so as to cover a small-diameter circular opening formed in an edge part of the panel. In this sound absorbing body, resonance frequencies of the coupled DMRs and the single DMR substantially match each other, and an extremely high absorption rate is achieved at a frequency lower than 500 Hz due to destructive interference caused by interaction thereof. Since this sound absorbing body is used while being attached to a square tube which has a square cross-section having the same size and a short subwavelength, there is no opening for air permeation.

A second sound absorbing body includes a hybrid membrane resonator (HMR) for the monopole resonator and the single DMR for the dipole resonator. Here, the hybrid membrane resonator (HMR) for the monopole resonator is obtained by sealing a cylindrical chamber which is attached to a sidewall of the short square tube having the square cross-section and whose back side is blocked by using the rubber film with the weight in the center. The single DMR for the dipole resonator is obtained by bonding the rubber film with the weight to the center so as to cover a large-diameter circular opening formed in the center of a disk-shaped panel which is arranged in the center of the square tube and is supported by an inner wall of the square tube through a rim. In this sound absorbing body, the resonance frequencies of the HMR and the single DMR are close to each other, and the extremely high absorption rate is also achieved at the frequency lower than 500 Hz due to the destructive interference caused by the interaction thereof. Since there is a gap between an outer edge of the disk-shaped panel and the inner wall of the square tube, this sound absorbing body has air permeability.

SUMMARY OF THE INVENTION

Incidentally, since most of the soundproof structures of the related art have performed the sound insulation with the mass of the structure, there is a disadvantage that the soundproof structure becomes large and heavy and it is difficult to perform low-frequency shielding.

Since the sound absorbing body disclosed in JP4832245B has a light weight and a high absorption rate whose peak value is 0.5 or more, it is possible to achieve the advanced sound absorption effect in a low-frequency region in which a peak frequency is 500 Hz or less. However, there is a problem that a range capable of selecting the sound absorbing material is narrow and it is difficult to select the sound absorbing material.

Since sound absorption using the coupling of the film vibration and the rear air layer is used as the principle, a thick frame and a rear wall are necessary in order to satisfy a condition. Thus, a place or a size to be provided is greatly restricted.

Since the sound absorbing material of such a sound absorbing body completely closes the through-hole of the frame body, this sound absorbing body has no ability to cause wind and heat to pass and is not able to exhaust air. Thus, the sound absorbing body tends to be filled with heat. Accordingly, in particular, there is a problem that such a sound absorbing material does not cope with sound insulation of noise of a device and an automobile or noise within a duct requiring air permeability, which is disclosed in JP4832245B.

In JP2009-139556A, since it is necessary to use the combination of the sound absorbing action due to the film vibration with the sound absorbing action due to the Helmholtz resonance, the posterior wall of the partition wall as the frame is blocked by the plate-shaped member. Thus, similarly to JP4832245B, the sound absorbing body disclosed in JP2009-139556A has no ability to cause wind and heat to pass and is not able to exhaust air, and thus, this sound absorbing body tends to be filled with heat. Accordingly, there is a problem that this sound absorbing material does not cope with sound insulation of noise of a device and an automobile or noise within a duct requiring air permeability.

The sound absorbing body disclosed in Subwavelength total acoustic absorption with degenerate resonators, Min Yang et. al., Applied Physics Letters 107, 104104 (2015) can be used at the frequency lower than 500 Hz and can achieve the extremely high absorption rate. However, since the film needs the weight, there are the following problems.

Since the weight is necessary, it is difficult to use this sound absorbing body in devices, automobiles, and general households whose structures are heavy.

There is no easy means for arranging the weight in each cell structure, and there is no manufacturing suitability.

Since a vibration mode is changed depending on a position of the weight by using the weight, it is difficult to adjust the position of the weight depending on the frequency.

That is, since the frequency and magnitude of the shielding greatly depend on the heaviness of the weight and the position on the film, this sound absorbing body has low robustness and has no stability, as the sound insulation material.

There is a problem that it is not possible to obtain an absorbance of more than 50% unless a rear surface is closed as in the sound absorbing bodies described in JP4832245B and JP2009-139556A and the first sound absorbing body described in Subwavelength total acoustic absorption with degenerate resonators, Min Yang et. al., Applied Physics Letters 107, 104104 (2015). However, in a case where the rear surface is closed, since it is not possible to obtain a passage of wind or heat, it is difficult to manufacture a small high-sound-absorption soundproof structure that can be used for the duct requiring the air permeability. A plurality of soundproof structures is arranged, and thus, the volume of all the soundproof structures becomes large. There is a need for a soundproof structure having a smaller size and a high absorbance, as the soundproof structure requiring space saving such as the duct.

A main object of the present invention is to provide a soundproof structure which is capable of solving the problems of the related art, is capable of achieving an absorbance of more than 50%, preferably, close to 100% even in a compact, light, and thin structure which is much smaller than a wavelength, and is capable of achieving all air permeability, heat conductivity, and a high soundproofing effect by providing a passage of air. As a result, a main object of the present invention is to further provide a soundproof structure which is capable of being arranged in a fan duct for soundproof of devices, automobiles, and general households or capable of being used as a fan duct having a soundproof function.

In addition to the main objects, another object of the present invention is to provide a soundproof structure which has high robustness as the sound insulation material without sound insulation characteristics such as a shielding frequency and a size depending on the shape thereof, has stability, is suitable for the purpose of devices, automobiles, and general households, and has excellent manufacturing suitability.

In the present invention, "soundproof" includes the meaning of both "sound insulation" and "sound absorption" as acoustic characteristics, but in particular, refers to "sound insulation". Here, "sound insulation" refers to "shielding sound", that is, "not allowing sound to pass through". Therefore, "soundproof" includes "reflecting" sound (reflection of sound) and "absorbing" sound (absorption of sound). (refer to Sanseido Daijirin (Third Edition) and http://www.onzai.or.jp/question/soundproof.html and http://www.onzai.or.jp/pdf/new/gijutsu201312_3.pdf on the web page of the Japan Acoustological Materials Society).

Hereinafter, basically, "sound insulation" and "shielding" are referred to in a case where "reflection" and "absorption" are not distinguished from each other. However, "reflection" and "absorption" are referred to in a case where "reflection" and "absorption" are distinguished from each other.

In order to achieve the objects, the present inventors have found out that it is difficult to cause the absorbance of more than 50% in the compact region which is much smaller than the wavelength by using the typical soundproof structure and it is necessary to use near-field interference between cells. Meanwhile, the present inventors have found out that it is necessary to maintain a passage of air since there are many fields in which it is necessary to achieve all air permeability or heat conductivity and high soundproofing effect within a fan duct for soundproofing within the device. As a result, the present inventors have derived the present invention.

That is, a soundproof structure according to the embodiment of the present invention comprises: two or more different kinds of resonant type sound absorbing cells; and an opening part. The opening part is disposed in a position in contact with both two resonant type sound absorbing cells of the two or more different kinds of resonant type sound absorbing cells, or the two resonant type sound absorbing cells are adjacent to each other, and the opening part is disposed in a position adjacent to at least one of the two resonant type sound absorbing cells. Resonance frequencies of one kind of first resonant type sound absorbing cells and resonance frequencies of the other kind of second resonant type sound absorbing cells different from the first resonant type sound absorbing cells match each other.

Here, it is preferable that the first resonant type sound absorbing cell includes a frame which has an opening and a film which is fixed around the opening of the frame and covers the opening.

It is preferable that the film is a single-layer film.

It is preferable that a first resonance frequency of the first resonant type sound absorbing cell including the film and the resonance frequency of the second resonant type sound absorbing cell match each other.

It is preferable that the opening part is an opening cell including a frame having an opening.

It is preferable that assuming that a circle equivalent radius which is a size of the frame is a (m), a thickness of the film is t (m), a Young's modulus of the film is E (Pa), and a density of the film is d (kg/m$^3$), a parameter B expressed by Expression (1) is equal to or greater than 15.47 and is equal to or less than 235000.

$$B=t/a^2*\sqrt{(E/d)} \quad (1)$$

It is preferable that the opening part has a tubular shape, or is covered by a wall-shaped structure having a length with which movement of sound is restricted in all directions of the opening part.

It is preferable that, assuming that a wavelength at the resonance frequency is λ, the first resonant type sound absorbing cells that satisfy a condition in which a distance between the first resonant type sound absorbing cell and the second resonant type sound absorbing cell closest to the first resonant type sound absorbing cell is less than λ/4 occupy 60% or more of all of the first resonant type sound absorbing cells.

It is preferable that the second resonant type sound absorbing cell includes a frame which has an opening and at least two layers of films which are fixed around the opening of the frame and cover the opening.

It is preferable that the at least two layers of films are two layers of films which are fixed around both sides of the opening of the frame and cover the opening.

It is preferable that the second resonant type sound absorbing cell includes a frame having an opening and at least two layers of plates which are fixed around the opening of the frame, cover the opening, and include through-holes, respectively.

It is preferable that the at least two layers of plates are two layers of plates which respectively include the through-holes, are fixed around both sides of the opening of the frame, and cover the opening.

It is preferable that the opening part includes the through-holes of the at least two layers of plates.

It is preferable that the second resonant type sound absorbing cell is a structure which has the through-holes respectively formed in the two layers of plates which cover both sides of the opening and has a resonance similar to a Helmholtz resonance.

It is preferable that the opening part includes a space which is formed on an outside of the first resonant type sound absorbing cell and/or on an outside of the second resonant type sound absorbing cell.

It is preferable that the opening part includes a space formed between the first resonant type sound absorbing cell and the second resonant type sound absorbing cell.

It is preferable that the first resonant type sound absorbing cell and the second resonant type sound absorbing cell are arranged in positions adjacent to each other and the opening part includes a space which is formed on the outside of the first resonant type sound absorbing cell or on the outside of the second resonant type sound absorbing cell which is on a side opposite to a side on which the first resonant type sound absorbing cell and the second resonant type sound absorbing cell are adjacent to each other.

It is preferable that the second resonant type sound absorbing cell includes a single-layer plate which has a through-hole and a housing which fixes the plate and forms a closed space on a rear surface of the plate.

It is preferable that the second resonant type sound absorbing cell is a structure having a Helmholtz resonance.

It is preferable that the first resonant type sound absorbing cell and the second resonant type sound absorbing cell are provided side by side at an interval, the through-hole of the plate of the second resonant type sound absorbing cell is formed in a position facing the first resonant type sound absorbing cell, and the opening part includes a portion formed between the first resonant type sound absorbing cell and the second resonant type sound absorbing cell.

It is preferable that the first resonant type sound absorbing cell and the second resonant type sound absorbing cell are arranged in a duct and the opening part includes a space between the first resonant type sound absorbing cell, the second resonant type sound absorbing cell, and an inner wall of the duct.

It is preferable that the resonance frequencies matched in the first resonant type sound absorbing cell and the second resonant type sound absorbing cell are included in a range of 10 Hz to 100000 Hz.

It is preferable that a cell structure includes at least three frames each having an opening, and in the cell structure, at least one first frame of the three frames to which a film is attached functions as the first resonant type sound absorbing cell, at least one second frame to which a film or a plate is attached and which is different from the first frame functions as the second resonant type sound absorbing cell, and at least one third frame which is different from the first frame and the second frame functions as the opening part.

According to the present invention, it is possible to achieve an absorbance of more than 50%, preferably, close to 100% even in a compact, light, and thin structure which is much smaller than a wavelength, and achieve all air permeability, heat conductivity, and a high soundproofing effect by providing a passage of air.

As a result, according to the present invention, the soundproof structure can be arranged in a fan duct for soundproof of devices, automobiles, and general households or can be used as a fan duct having a soundproof function.

According to the present invention, it is possible to provide a soundproof structure which has high robustness as the sound insulation material without sound insulation characteristics such as a shielding frequency and a size depending on the shape thereof, has stability, is suitable for the purpose of devices, automobiles, and general households, and has excellent manufacturing suitability.

DESCRIPTION OF THE PREFERRED EMBODIMENTS

Figure 1:
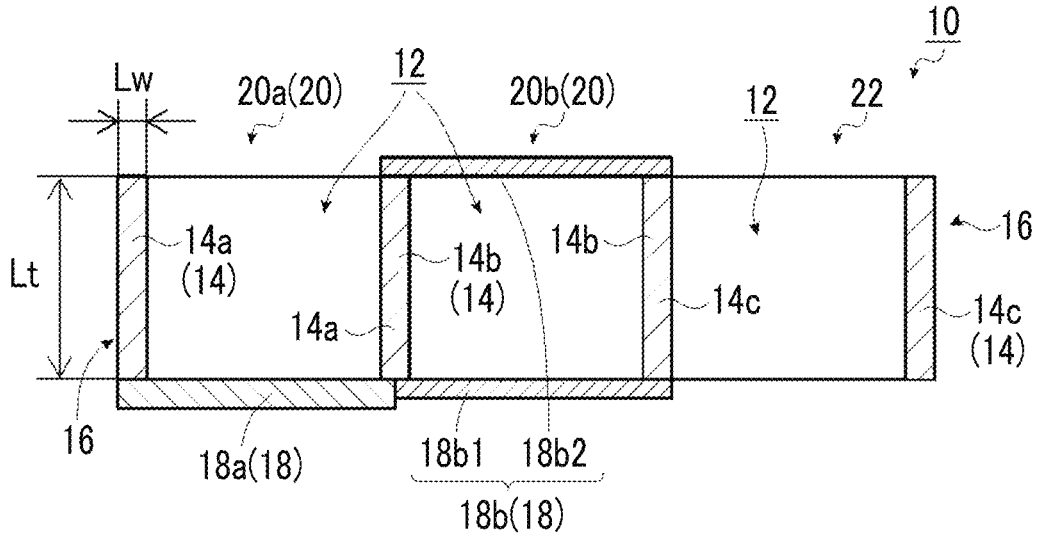
FIG. 1 is a schematic cross-sectional view showing an example of a soundproof structure according to an embodiment of the present invention.

Hereinafter, a soundproof structure according to embodiments of the present invention will be described in detail with reference to preferred embodiments shown in the accompanying diagrams.

The soundproof structure according to the embodiment of the present invention is a structure which achieves an absorbance of more than 50%, preferably close to 100%, and leaves a passage of air.

In the present invention, a method in which transmitted waves of a plurality of resonant type sound absorbing cells are removed due to the interference and absorption is increased by causing interference with which the transmitted waves cancel each other is used as a principle to obtain an absorbance of more than 50%, preferably close to 100%. It is desirable to have a structure in which a plurality of resonant type sound absorbing cells is arranged within a size which is smaller than the wavelength, and the transmitted waves of the cells interfere so as to cancel each other in a near-field region and the transmitted waves are removed. In order to achieve this, it is most desirable that the phases of the transmitted waves are inverted between two resonant type sound absorbing cells. The two resonant type sound absorbing cells have a phase relationship such that the transmitted waves cancel each other.

Thus, the soundproof structure according to the embodiment of the present invention includes two or more kinds of resonant type sound absorbing cells. In the present invention, it is necessary to match a resonance frequency of one kind of a first resonant type sound absorbing cell of different kinds of two adjacent resonant type sound absorbing cells of two or more kinds of resonant type sound absorbing cells with a resonance frequency of the other kind of a second resonant type sound absorbing cell different from the first resonant type sound absorbing cell. At this time, it is preferable that the resonance frequency of the first resonant type sound absorbing cell is, for example, a first resonance frequency. The resonance frequency of the second resonant type sound absorbing cell is preferably the first resonance frequency or a higher-order resonance frequency, and more preferably a second resonance frequency.

In the present invention, a vibration film structure whose surrounding is fixed a frame is used as one resonant type sound absorbing cell (first resonant type sound absorbing cell). For example, the phases of the transmitted waves are inverted at the first resonance frequency due to displacement of a single-layer film.

Accordingly, a structure in which the phases of the transmitted waves are not inverted may be used as the other resonant type sound absorbing cell (second resonant type sound absorbing cell).

Specifically, the following sound absorbing cell may be used as the second resonant type sound absorbing cell.

1. film structure of multiple layers (hereinafter, referred to as a first embodiment). For example, the second resonant type sound absorbing cell has a phase relationship with the first resonant type sound absorbing cell such that the transmitted waves cancel each other by using a mode in which film vibration is displaced backwards.

2. multi-layer plate structure in which plates having holes formed therein are multiple layers (hereinafter, referred to as a second embodiment). The second resonant type sound absorbing cell has a configuration (a structure has a resonance similar to a Helmholtz resonance) as in a Helmholtz resonator having holes formed in both sides due to the expansion and compression of air confined in a central portion. At this time, a mode in which sound travels backwards through the plate-holes on both the sides is used.

3. Helmholtz resonator (structure having Helmholtz resonance) transversely arranged (hereinafter, referred to as a third embodiment).

However, the present invention is not limited thereto, and a relationship in which the phases of the transmitted waves of the first resonant type sound absorbing cell and the phases of the transmitted waves of the second resonant type sound absorbing cell cancel each other may be satisfied. For example, even though the first resonant type sound absorbing cell has not the first resonance frequency but the higher-order resonance frequency, since the phases are changed, the second resonant type sound absorbing cell having the phases of the transmitted waves for canceling the phase changes may be used.

In the present invention, it is necessary to provide a passage of air. Thus, the soundproof structure according to the embodiment of the present invention needs to include an opening part between different kinds of two adjacent resonant type sound absorbing cells of the two or more kinds of resonant type sound absorbing cells or on an outside of at least one resonant type sound absorbing cell of the two resonant type sound absorbing cells in addition to the two or more different kinds of resonant type sound absorbing cells. In the present invention, a case where the opening part is provided between the two resonant type sound absorbing cells can mean that the opening part is disposed in a position in contact with both the two resonant type sound absorbing cells. A case where the opening part is provided on the outside of at least one resonant type sound absorbing cell can mean that the two resonant type sound absorbing cells are adjacent to each other and the opening part is disposed in a position adjacent to at least one resonant type sound absorbing cell.

In the present invention, a case where the two resonant type sound absorbing cells are adjacent to each other means that the two resonant type sound absorbing cells are in contact with each other without gap, for example, side surfaces of the resonant type sound absorbing cells are closely attached to each other without being shifted. However, the present invention is not limited thereto. As long as sound can cancel each other due to interference caused by changes in phases of the two resonant type sound absorbing cells to be described below, the two resonant type sound absorbing cells may not be closely attached to each other, and may be arranged at an interval. The two resonant type sound absorbing cells, for example, the side surfaces thereof may be shifted. In a case where the two resonant type sound absorbing cells are arranged at a slight gap, the slight gap function as a part of the opening part as long as air and/or heat can pass through the slight gap.

As stated above, since the plurality of resonant type sound absorbing cells individually resonate, even though the opening part, for example, an opening cell is present in another portion (a portion other than the plurality of resonant type sound absorbing cells), an effect of attracting sound to the resonant type sound absorbing cells is demonstrated.

Accordingly, in the soundproof structure according to the embodiment of the present invention, it is possible to achieve a high absorbance even though a simply opened portion, for example, the opening part or the opening cell is provided in addition to the two or more kinds of resonant type sound absorbing cells including the first resonant type sound absorbing cell having the vibration film structure and the second resonant type sound absorbing cell described in the first embodiment, the second embodiment, or the third embodiment. That is, the soundproof structure according to the embodiment of the present invention is a structure serving as an opening structure including an opening part through which wind and heat pass and a resonance absorption structure due to interaction of the two resonant type sound absorbing cells.

In a case where the multi-layer plate structure having the holes of the second embodiment is used, since through-holes are formed in the plates at both the ends in addition to the opening part, it is possible to more easily secure a passage of air and heat.

First Embodiment

Figure 2:
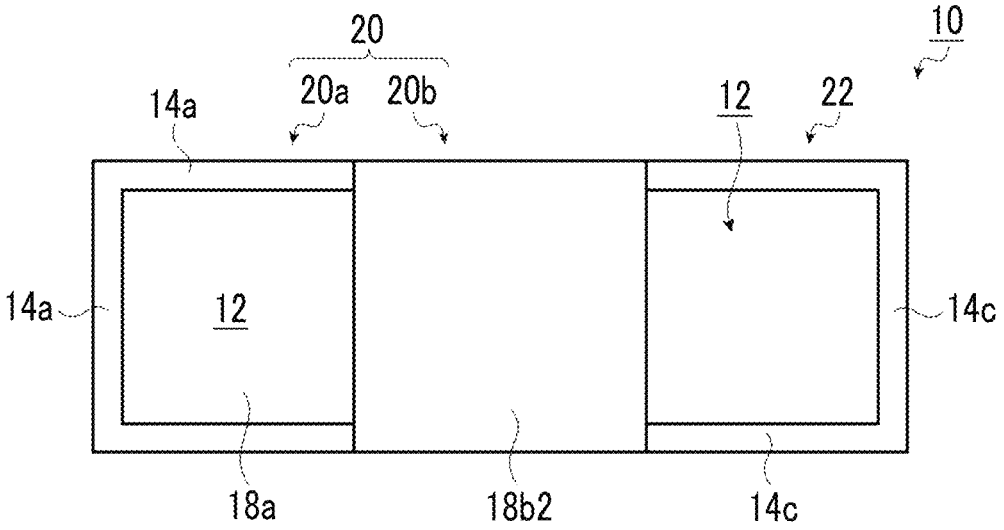
FIG. 2 is a schematic plan view of the soundproof structure shown in FIG. 1.
Figure 3:
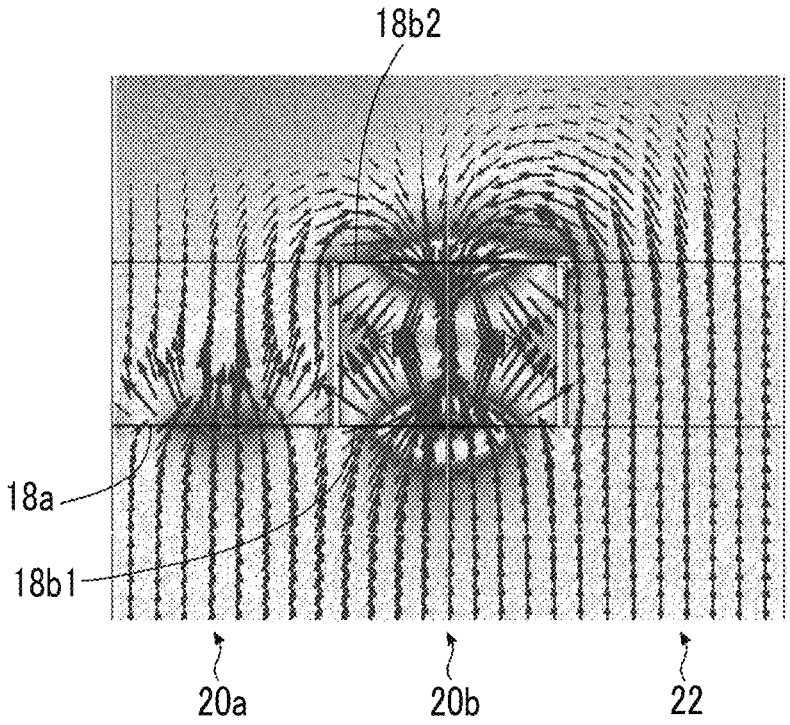
FIG. 3 is a schematic diagram showing a local velocity in film displacement of the soundproof structure shown in FIG. 1.

FIG. 1 is a schematic cross-sectional view showing an example of a soundproof structure according to a first embodiment of the present invention, FIG. 2 is a schematic plan view of the soundproof structure shown in FIG. 1, and FIG. 3 is a schematic diagram showing a local velocity of a film displacement of the soundproof structure shown in FIG. 1.

A soundproof structure 10 of the first embodiment of the present invention shown in FIGS. 1 to 3 uses a vibration film structure as a first resonant type sound absorbing cell which is one sound absorbing cell of the present invention and uses the structure of the first embodiment described above as a second resonant type sound absorbing cell which is the other sound absorbing cell of the present invention. Here, a phase of the vibration film structure as the first resonant type sound absorbing cell is inverted by displacement of a single-layer film whose surrounding is fixed to the frame. Meanwhile, the structure of the first embodiment as the second resonant type sound absorbing cell is a vibration film structure of multiple layers whose phases are not inverted by using a mode in which film vibration is displaced backwards.

The soundproof structure 10 of the first embodiment includes two kinds of resonant type sound absorbing cells arranged so as to be adjacent to each other, for example, one first resonant type sound absorbing cell (hereinafter, simply referred to as a first sound absorbing cell or a sound absorbing cell) 20*a* and the other second resonant type sound absorbing cell (hereinafter, simply referred to as a second sound absorbing cell or a sound absorbing cell) 20*b*, and an opening cell 22 arranged so as to be adjacent to the other second sound absorbing cell 20*b*. The opening cell 22 constitutes an opening part of the present invention.

The first sound absorbing cell 20*a*, the second sound absorbing cell 20*b*, and the opening cell 22 have openings 12*a*, 12*b*, and 12*c*, respectively, and comprise a frame body 16 which forms three adjacent frames 14*a*, 14*b*, and 14*c*.

In the examples shown in FIGS. 1 and 2, the frames 14*a* and 14*b* are adjacent to each other, share a member at an adjacent portion, and the frames 14*b* and 14*c* are adjacent to each other, and share a member at an adjacent portion. However, the present invention is not limited thereto, and the frames 14*a*, 14*b*, and 14*c* may be independent from each other.

The first sound absorbing cell 20*a* is the first resonant type sound absorbing cell of the vibration film structure of the single layer, and comprises a film 18*a* which covers one end portion of the opening 12*a* of the frame 14*a*. The other end portion of the opening 12*a* is opened.

The second sound absorbing cell 20*b* is the second resonant type sound absorbing cell of the vibration film structure of the multiple layers, and comprises two films 18*b* (two films 18*b*1 and 18*b*2) which cover both end portions of the opening 12*b* of the frame 14*b*.

The opening cell 22 constitutes an opening part of the present invention, and both end portions of the opening 12*c* of the frame 14*c* are opened.

Here, it is preferable that the opening part of the present invention is not an orifice but is in a tubular shape like the opening cell 22 in the illustrated example. Alternatively, it is preferable that the opening part of the present invention has a wall-shaped structure in which movement of sound is restricted in all directions of the opening part with at least a certain length. In other words, it is preferable that the opening part of the present invention is surrounded in the wall-shaped structure having the length with which the movement of the sound is restricted in all the directions of the opening part.

The opening cell 22 causes heat and/or air to pass through the opening 12.

In the present invention, a ratio (percentage %) of an area of the opening 12 of the opening cell 22 to the sum of areas of the first sound absorbing cell 20*a*, the second sound absorbing cell 20*b*, and the opening cell 22 parallel to a surface covered by the films 18 (18*a* and 18*b*) is defined as an opening ratio. That is, the opening ratio can be referred to as a ratio of an area of the opened opening part to the entire area of the soundproof structure 10. The opening ratio can be obtained from sizes of the first sound absorbing cell 20*a*, the second sound absorbing cell 20*b*, and the opening cell 22. In a case where the opening cell 22 is present between the first sound absorbing cell 20*a* and the second sound absorbing cell 20*b*, the opening ratio can be obtained from the sizes of the first sound absorbing cell 20*a* and the second sound absorbing cell 20*b* and a distance between both the sound absorbing cells.

In the present invention, the opening ratio is not particularly limited as long as the opening ratio at which the heat and/or air can pass is used. However, the opening ratio is preferably 1% to 90%, more preferably 5% to 85%, even more preferably 10% to 80%, and most preferably 20% to 80%.

The reason why the opening ratio is preferably 1% to 90% is that in a case where the opening ratio exceeds 90%, sound flowing through the opening 12 without being coupled to a resonant state of the films 18 becomes large and a transmittance also becomes large at a resonance frequency. In particular, in a case where the opening 12 is opened with a large area, an area corresponding to the end portions of the opening 12 becomes small as compared to a case where there are innumerable small openings 12. Even though there is the opening 12, it is hard for the sound to pass due to a friction effect caused by viscosity of air in the vicinity of the end portions of the opening 12. However, in a case where the opening is opened with the large area, the friction effect is less effective, and the sound passes through the opening. Thus, in a case where the opening ratio exceeds 90%, there is a problem that the sound passes even at the resonance frequency and an absorption amount becomes small.

In a case where the opening ratio is lower than 1%, the effect of causing heat or wind to pass through the opening, which is stated in the object is hardly obtained.

In the present invention, the first and second sound absorbing cells 20*a* and 20*b* are two different kinds of sound absorbing cells, and the resonance frequencies thereof match each other.

In the present invention, since it is necessary to match the resonance frequencies of the first and second sound absorbing cells 20*a* and 20*b*, at least one set of the frames 14*a* and 14*b* or the films 18*a* and 18*b* (18*b*1 and 18*b*2) is different from each other.

That is, in a case where the two frames 14*a* and 14*b* are identical to each other, the two films 18*a* and 18*b* are different from each other. A case where the films 18*a* and 18*b* are different includes a case where the films 18*b*1 and 18*b*2 are identical to each other and are different from the film 18*a*, a case where one of the films 18*b*1 and 18*b*2 is identical to the film 18*a* and the other one is different from the film 18*a*, and a case where both the films 18*b*1 and 18*b*2 are different from the film 18*a*.

In a case where the film 18*a* and the two films 18*b* are identical to each other (that is, all the films 18*a*, 18*b*1, and 18*b*2 are identical to each other), the two frames 14*a* and 14*b* are different from each other.

In a case where the two films 18*a* and 18*b*2 are identical to each other, these films may be formed as one sheet-shaped film body.

Of course, in a case where the two frames 14*a* and 14*b* are different from each other, the films 18*a* and 18*b* may be different from each other.

In the present invention, a case where the resonance frequency of the "first (resonant type) sound absorbing cell" and the resonance frequency of the "second (resonant type) sound absorbing cell" match each other means that a first resonance frequency of the first sound absorbing cell and a first resonance frequency of the second sound absorbing cell or higher-order resonance frequency (preferably, second resonance frequency) match each other.

Here, the matching resonance frequencies (for example, the first resonance frequency (basic resonance) of the first sound absorbing cell and the resonance frequency (coincidence resonance) of the second sound absorbing cell, that is, the first resonance frequency or the higher-order resonance frequency) are preferably 10 Hz to 100000 Hz which is equivalent to a range of sound waves that can be sensed by humans, more preferably 20 Hz to 20000 Hz which is an audible range of sound waves that can be heard by humans, even more preferably 40 Hz to 16000 Hz, and most preferably 100 Hz to 12000 Hz.

The reason why the matching resonance frequencies (the first resonance frequency of the first sound absorbing cell and the first-order and higher-order resonance frequencies of the second sound absorbing cell) are preferably 10 Hz to 100000 Hz is that since the object of the present invention is to prevent the sound heard by human's ears or the sound sensed by humans through the absorption, the humans can sense the sound in this range. Since the range of 20 Hz to 20000 Hz is equivalent to the range (audible range) of the sound that can be heard by the humans, the matching resonance frequencies have more desirably this range.

In the present invention, a case where the first resonance frequency of the "first sound absorbing cell" and the higher-order resonance frequency of the "second sound absorbing cell" match each other means that in a case where there is a difference between two resonance frequencies, that is, the first resonance frequency of the first sound absorbing cell and the higher-order resonance frequency of the second sound absorbing cell, $\Delta F/F0$ falls within a range of 0.2 or less in which a frequency on a high frequency side is F0 and the magnitude of the difference between the two resonance frequencies is $\Delta F$. For example, in a case where F0 is 1 kHz, the difference is within ±200 Hz. ΔF/F0 is more preferably 0.10 or less, even more preferably 0.05 or less, and most preferably 0.02 or less.

The reason why it is preferable that the difference between the first resonance frequency of the first sound absorbing cell and the higher-order resonance frequency of the second sound absorbing cell satisfies that ΔF/F0 is 0.2 or less is that the principle of the present invention uses interference between resonant modes in which transmission phases of two different cells are different from each other. That is, in a case where the difference between the resonance frequencies exceeds the condition, since the frequencies causing the resonance are too far apart from each other, the frequencies that excite strong resonance for the two cells disappear. Thus, the resonance is merely excited for the two cells such that only one cell is in a strong resonant state or both the cells are in a weak resonant state which is substantially deviated from the resonance. In the former case, since only one cell is in the strong resonant state, the interference with which the resonances cancel each other is not caused. In the latter case, since the resonances in the cells are substantially deviated from the resonance, an effect of attracting and collecting sound through the resonance is small, and the amount of sound passing through the opening becomes large. As a result, a transmittance becomes high.

Hereinafter, among the constituent elements of the two first and second sound absorbing cells 20*a* and 20*b*, the frames 14*a*, 14*b*, and 14*c*, and the films 18*a* and 18*b* of the soundproof structure 10, different portions will be individually described. However, portions which are identical to each other and do not need to be particularly distinguished from each other will be collectively described as the sound absorbing cells 20, the frames 14, and the films 18 without distinguishing from each other.

In the present invention, a case where the two frames 14 (14*a* and 14*b*) are different means that at least one of frame shapes (shapes of the frames 14), kinds (physical properties, stiffness, and materials) of the frames 14, or dimensions such as frame widths (plate thickness of constituent members of the frames 14: Lw), frame thicknesses (lengths of the constituent members of the frames 14=distances between both ends of the openings 12: Lt), and frame sizes (sizes of the frames 14 or sizes (sizes of opening areas and sizes of space volumes)) of the openings 12 of the frames 14) is different.

In contrast, a case where the two frames 14 (14*a* and 14*b*) are identical to each other means that at least all the shapes, kinds, and dimensions of the two frames 14 are identical to each other.

A case where the two films 18 (18*a* and 18*b* (18*b*1 and 18*b*2)) are different from each other means that at least one of kinds (physical properties such as Young's modulus and density, stiffness, and materials) of the films 18, or dimensions such as film sizes (sizes of the films 18) and film thicknesses (thicknesses of the films 18) is different in the two films 18 (specifically, at least one set of the films 18*a* and 18*b* or the films 18*b*1 and 18*b*2).

In contrast, a case where the two films 18*a* and 18*b* (18*b*1 and 18*b*2) are identical to each other means that at least all the shapes, kinds, and dimensions of the two films are identical to each other.

In the structure in which the first sound absorbing cell 20*a*, the second sound absorbing cell 20*b*, and the opening cell 22 are provided, the soundproof structure 10 of the embodiment shown in FIGS. 1 and 2 adjusts at least one of the configurations (that is, the frame shapes, kinds, frame widths, frame thickness (distance between two layer films), and the frame sizes (film sizes of the films 18) of the frames 14, and the kinds and the film thickness of the films 18) of the frames 14 and the films 18 such that the first resonance frequency of the first sound absorbing cell 20*a* and the higher-order (for example, the second) resonance frequency of the second sound absorbing cell 20*b* match each other.

Specifically, the soundproof structure adjusts the configurations of the frames 14 and the films 18 such that the resonance frequencies of the resonant modes in which the displacements of the films 18*b*1 and 18*b*2 as two layers move directions opposite to each other match each other, of the first resonance frequency of the film 18*a* as one layer of the first sound absorbing cell 20*a* and the resonance frequency of the higher-order mode of the second sound absorbing cell 20*b*, as represented in a local velocity distribution around the soundproof structure 10 shown in FIG. 3.

FIG. 3 shows the local velocity distribution of sound waves generated in a case where the sound waves are incident on the soundproof structure 10 from the bottom of FIG. 1.

It can be seen from the local velocity distribution of FIG. 3 that a normal first resonance frequency mode is excited for the film 18*a* by an incidence sound pressure and a large vibration state is generated in the central portion in the sound absorbing cell 20*a* including the film 18*a* as one layer (single layer). Meanwhile, it can be seen that the displacements of the films of the resonant modes in which the displacements of the films 18*b*1 and 18*b*2 as two layers move in the directions opposite to each other due to the incidence sound pressure are caused in the sound absorbing cell 20*b* including the films 18*b*1 and 18*b*2 as two layers. This is because the films 18*a* and 18*b*1 of the sound absorbing cells 20*a* and 20*b* are simultaneously pressed by the incidence sound pressure, as shown in FIG. 3. However, the phase of the sound waves in the sound absorbing cell 20*b* on an emission side (that is, a side opposite to the direction in which the sound waves are incident) of the sound waves is inverted with respect to the phase of the sound waves in the sound absorbing cell 20*a*. Accordingly, the film 18*a* and the film 18*b*2 have an interference relationship such that the waves transmitted through the film 18*a* and the waves transmitted through the film 18*b*2 cancel each other. FIG. 3 shows the local velocity distribution in which the sound waves transmitted through the film 18*a* of the sound absorbing cell 20*a* and the sound waves transmitted through the opening cell 22 are attracted to the film 18*b*2 of the sound absorbing cell 20*b*. This local velocity distribution shows that the sound absorbing cells have a phase relationship causing interference with which the transmission phase of the sound absorbing cell 20*b* and the transmission phase of the other sound absorbing cell 20*a* cancel each other. As a result, it can be seen that the sound waves transmitted through the film 18*a* and the sound waves transmitted through the film 18*b*2 cancel each other and the transmitted waves traveled to a distant location are ultimately reduced.

It can be seen that the local velocity of the film displacement becomes low and the sound waves transmitted through the sound absorbing cells 20*a* and 20*b* and the opening cell 22 are reduced on the upper side of FIG. 3.

That is, the first resonance frequency of the film 18*a* as one layer of the sound absorbing cell 20*a* and the higher-order resonance frequency of the films 18*b*1 and 18*b*2 as two layers of the sound absorbing cell 20*b* match each other, and thus, the sound absorbing cell 20*a* and the sound absorbing cell 20*b* can interact with each other with the interference relationship such that the waves cancel each other in the soundproof structure 10 of the present embodiment. As a result, it can be seen that it is possible to obtain an absorbance of the sound waves which is much higher than 50% even though the sound absorbing cells 20 are constituted such that the frame sizes are smaller than 1/10 of the wavelength of the sound waves. In the soundproof structure 10 of the present embodiment, the transmitted waves cancel each other in a region sandwiched between the first resonance frequencies, and thus, it is possible to increase a transmission loss.

Figure 4:
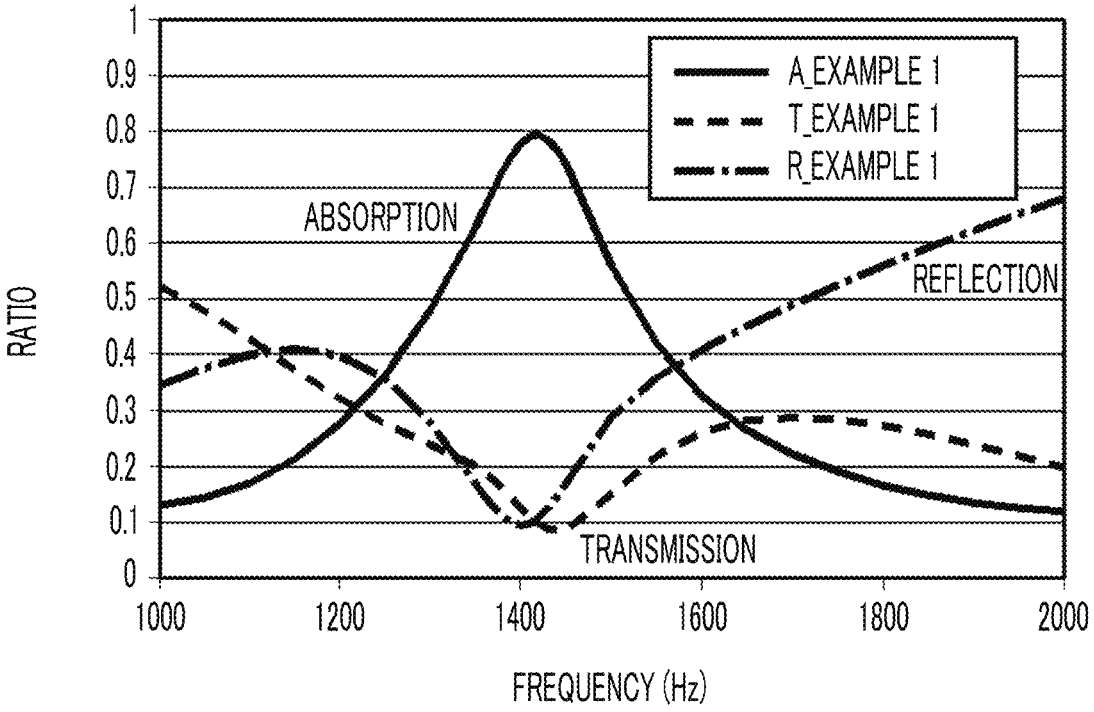
FIG. 4 is a graph showing soundproofing characteristics of Example 1 of the soundproof structure shown in FIG. 1.

As stated above, the first resonance frequency of the first sound absorbing cell 20*a* and the higher-order resonance frequency of the second sound absorbing cell 20*b* match each other, and thus, the soundproof structure 10 comprising the first sound absorbing cell 20*a*, the second sound absorbing cell 20*b*, and the opening cell 22 demonstrates the maximum (peak) absorbance of the sound at a specific frequency. For example, as will be described in detail, the soundproof structure 10 in which the first sound absorbing cell 20*a*, the second sound absorbing cell 20*b*, and the opening cell 22 are arranged so as to be adjacent to each other as shown in FIGS. 1 and 2 demonstrates a peak (maximum) absorbance which is the maximum value of an absorbance A of the sound at a specific frequency of 1420 Hz in soundproofing characteristics of Example 1 shown in FIG. 4. In other words, in the soundproof structure 10 of Example 1 has a frequency of 1420 Hz which is the specific frequency demonstrating the peak absorbance, as shown in FIG. 4. The specific frequency demonstrating the peak absorbance can be referred to as an absorption peak (maximum) frequency. At this time, the absorption peak frequency can be the frequency (for example, the higher-order resonance frequency of the second sound absorbing cell) matched in the first sound absorbing cell 20*a* and the second sound absorbing cell 20*b* or can be substantially equal to the higher-order resonance frequency of the second sound absorbing cell. In FIG. 4, a transmittance T and a reflectance R are also represented in addition to the absorbance, as the soundproofing characteristics.

The soundproof structure 10 of the present embodiment shown in FIGS. 1 and 2 matches the first resonance frequency of the film vibration of one sound absorbing cell (that is, the first sound absorbing cell 20*a* of the film 18*a* as one layer) of two kinds of sound absorbing cells 20 whose first resonance frequencies are different with the higher-order resonance frequency of the film vibration of the other sound absorbing cell (that is, the second sound absorbing cell 20*b* of the films 18*b* (18*b*1 and 18*b*2) as two layers). By doing this, at the frequency (for example, the higher-order resonance frequency of the second sound absorbing cell 20*b*) in which both the resonance frequencies match each other, it is possible to obtain a high absorbance of the sound which is much higher than 50%, which is not possible to be achieved in a soundproof structure including sound absorbing cells 20*a* and 20*b* and an opening cell 22 which are independent from each other (that is, it is possible to achieve a peak absorbance).

Figure 5:
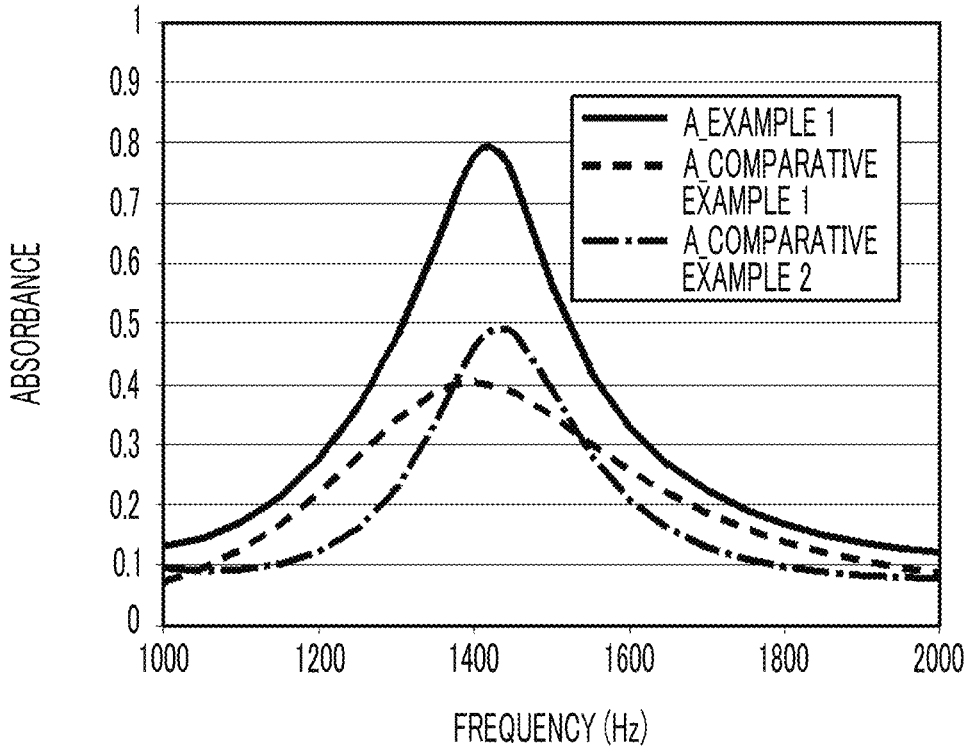
FIG. 5 is a graph showing absorption characteristics of sound of Example 1, Comparative Example 1, and Reference Example 1 of the soundproof structure shown in FIG. 1.

That is, for example, peak absorbances respectively achieved in a soundproof structure of Comparative Example 1 including the single sound absorbing cell 20*a* and the opening cell 22 and a soundproof structure of Comparative Example 2 including the single sound absorbing cell 20*b* and the opening cell 22 are 40% an 49%, as shown in FIG. 5 to be described below. In contrast, the soundproof structure 10 of the present embodiment shown in FIGS. 1 and 2 are designed such that the first resonance frequency of the film 18*a* as one layer and the higher-order resonance frequency of the films 18*b* as two layers match each other. As a result, it is possible to achieve the absorbance (an absorbance of the sound which is 80% as in the example shown in FIG. 5) of the sound which is much higher than 50% which is not able to be achieved in the soundproof structure including the single sound absorbing cell 20*a* or 20*b* and the opening cell 22. For example, the absorbance of the sound which is much higher than 50% is achieved even though the frame sizes, frame thicknesses, or the distance between the two layers (between the films) of the frames 14 of the sound absorbing cells 20 is smaller than 1/4 of the wavelength of the sound waves.

In a general soundproof structure, since the size of the soundproof cell is extremely smaller than the size of the wavelength of the sound waves, it is extremely difficult to realize the absorbance of 50% or more.

This can be seen from the absorbance derived by a continuity equation of the pressure of the sound waves to be represented below.

The absorbance A is determined as A=1−T−R.

The transmittance T and the reflectance R are expressed by transmission coefficient t and reflectance coefficient r, and $T=|t|^2$, $R=|r|^2$.

Assuming that an incidence sound pressure, a reflection sound pressure, and a transmission sound pressure are respectively $p_I$, $p_R$, and $p_T$ ($p_I$, $p_R$, and $p_T$ are complex numbers), the continuity equation of the pressure which is a basic of the sound waves which interact with the structure including the film as one layer is $p_I=p_R+p_T$. Since $t=p_T/p_T$ and $r=p_T/p_T$, the continuity equation of the pressure is expressed as follows.

$$1=t+r$$

Accordingly, the absorbance A is obtained. Re represents a real part of the complex number, and Im represents an imaginary part of the complex number.

$$\begin{aligned} A &= 1-T-R = 1-|t|^2-|r|^2 = 1-|t|^2-|1-t|^2 \\ &= 1-(\mathrm{Re}(t)^2+\mathrm{Im}(t)^2)-((\mathrm{Re}(1-t))^2+(\mathrm{Im}(1-t))^2) \\ &= 1-(\mathrm{Re}(t)^2+\mathrm{Im}(t)^2)-(1-2\mathrm{Re}(t)+\mathrm{Re}(t)^2+\mathrm{Im}(t))^2) \\ &= -2\mathrm{Re}(t)^2+2\mathrm{Re}(t)-2\mathrm{Im}(t)^2 \\ &= 2\mathrm{Re}(t)\times(1-\mathrm{Re}(t))-2\mathrm{Im}(t)^2 < 2\mathrm{Re}(t)\times(1-\mathrm{Re}(t)) \end{aligned}$$

The equation is an equation expressed as 2x×(1−x), and has a range of 0≤x≤1.

In this case, it can be seen that the absorptance has the maximum value in a case where x=0.25 and 2x(1−x)≤0.5. Thus, it can be seen that A<Re(t)×(1−Re(t))≤0.5 and the absorbance in the single structure is at most 0.5.

As stated above, it can be seen that the absorbance of the sound in the structure (first soundproof cell) including the film as one layer remains at 50% or less.

In the case of the structure (second soundproof cell) including the films as two layers and the (inter-layer) distance between the two layers is extremely smaller than the size of the wavelength of the sound (specifically, is smaller than 1/4), since it is difficult to achieve the phases in which the transmitted waves in the two layers cancel each other, the absorbance of the sound remains at about 50%. It can be seen from FIG. 5 showing sound absorbing characteristics of the soundproof structure of Comparative Example 2 to be described below that the first resonance frequency corresponding to the sound absorbing cell 20*b* including the films as two layers is 1440 Hz and the absorbance of the sound corresponding to this frequency is 49% which is about 50%.

As stated above, according to the soundproof structure of the present embodiment, it is possible to obtain the absorbance of the sound which is much higher than the absorbance of the related art by simply changing the frame sizes or adjusting the frame thicknesses, for example.

In the soundproof structure 10 shown in FIGS. 1 and 2, the first sound absorbing cell 20*a*, the second sound absorbing cell 20*b*, and opening cell 22 are adjacent to each other. Specifically, these cells are consecutively provided in this order (that is, these cells are consecutively provided without gap), and the opening cell 22 is provided on the outside of the second sound absorbing cell 20*b*. However, in the present invention, the method of arranging the cells is not limited thereto, and may be arranged by any method. That is, the order in which the first sound absorbing cell 20*a*, the second sound absorbing cell 20*b*, and the opening cell 22 are consecutively provided may be any order, and the opening cell 22 may be provided in any position. For example, as in a soundproof structure 10*a* shown in FIG. 6, a second sound absorbing cell 20*b*, a first sound absorbing cell 20*a*, and the opening cell 22 may be consecutively provided in this order, and the opening cell 22 may be provided on the outside of the first sound absorbing cell 20*a*. As in a soundproof structure 10*b* shown in FIG. 7, the first sound absorbing cell 20*a*, the opening cell 22, and the second sound absorbing cell 20*b* may be consecutively provided in this order, and the opening cell 22 may be provided between the first sound absorbing cell 20*a* and the second sound absorbing cell 20*b*.

Figure 6:
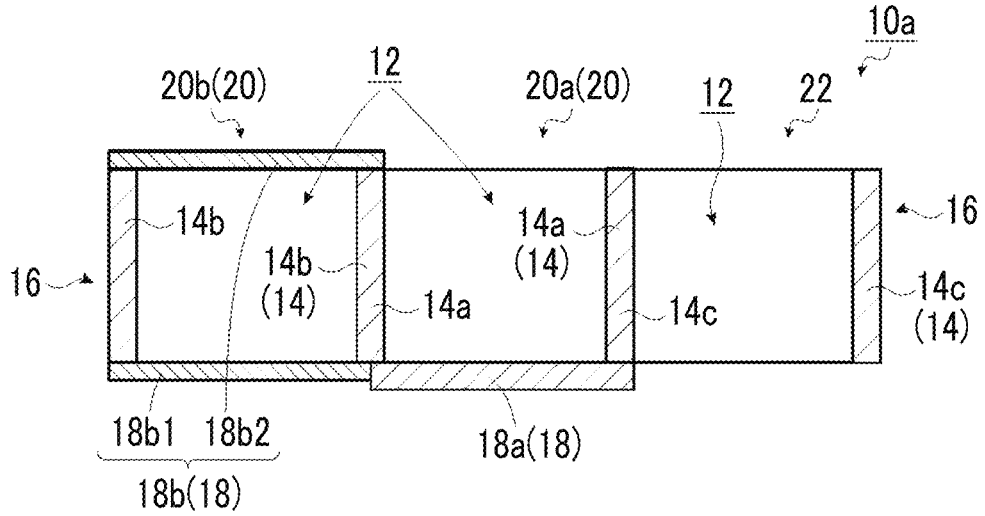
FIG. 6 is a schematic cross-sectional view of another example of the soundproof structure according to the embodiment of the present invention.
Figure 7:
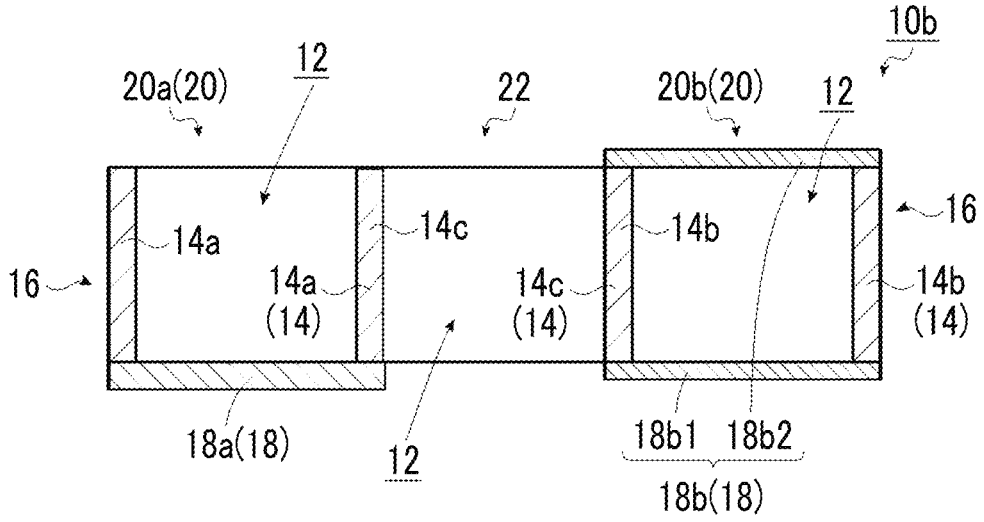
FIG. 7 is a schematic cross-sectional view of another example of the soundproof structure according to the embodiment of the present invention.

Although the sizes of the first sound absorbing cell 20*a*, the second sound absorbing cell 20*b*, and the opening cell 22 are identical to each other in the soundproof structures 10, 10*a*, and 10*b* shown in FIGS. 1, 6, and 7, the present invention is not limited thereto. The size (for example, the dimension of the cell such as the frame size) of at least one cell of these cells may be different from the size of the other cell. Of course, all the cells may have different sizes.

It is preferable that the opening cell 22 as the opening part is present on the outside (at the end portion) of any of the two sound absorbing cells 20*a* and 20*b* as in the soundproof structures 10 and 10*a* shown in FIGS. 1 and 6 as compared to a case where the opening cell is present between the two sound absorbing cells 20*a* and 20*b* as in the soundproof structure 10*b* shown in FIG. 7. The reason is that the two sound absorbing cells 20*a* and 20*b* that interact with the incident sound waves are arranged so as to be close to each other (preferably, these sound absorbing cells are consecutively provided so as to be in contact with each other without gap) as described above in order to achieve a high absorbance of the sound. That is, the two sound absorbing cells 20*a* and 20*b* are arranged such that the side surfaces of the resonant type sound absorbing cells are closely attached to each other without being shifted, and thus, it is possible to achieve a high absorbance of the sound.

Figure 8A:
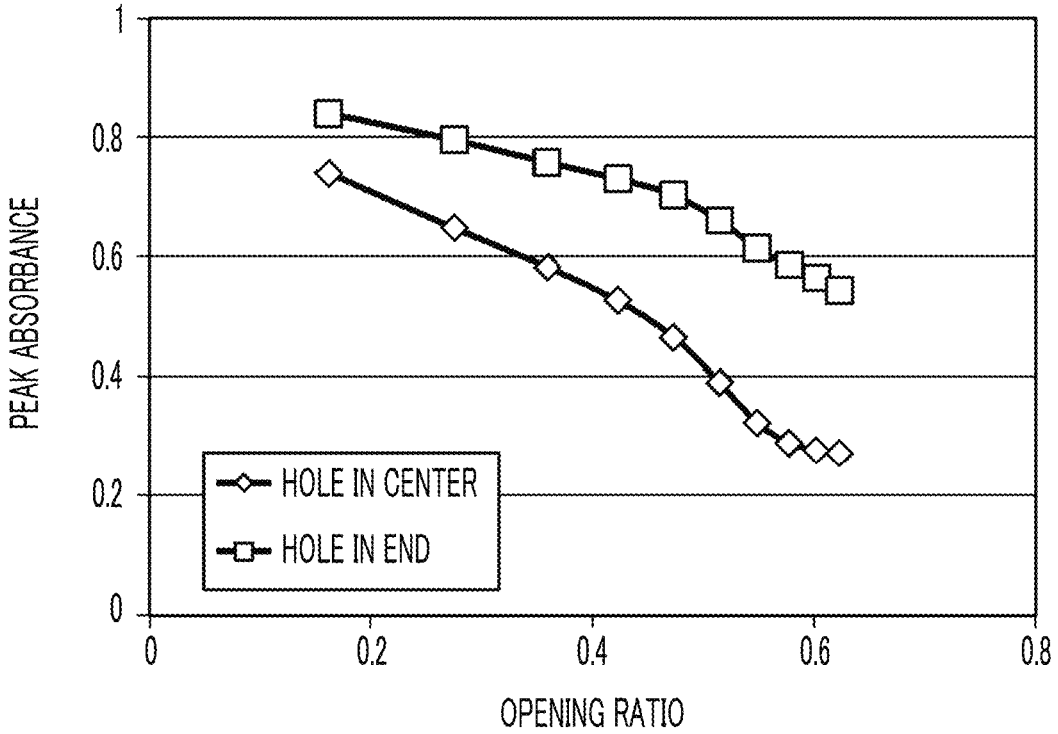
FIG. 8A is a graph showing the relationship between an absorbance of sound at 1400 Hz and an opening ratio in the soundproof structure shown in FIG. 1 and the soundproof structure shown in FIG. 7.
Figure 8B:
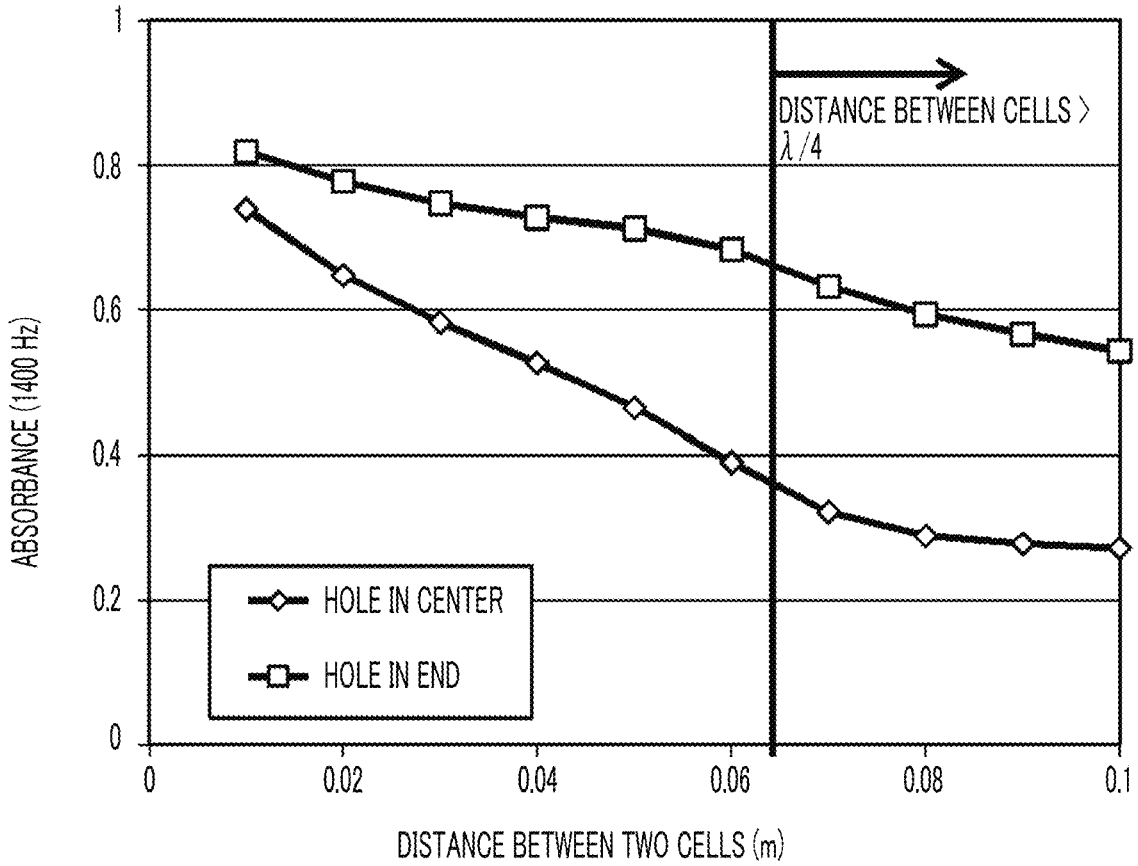
FIG. 8B is a graph showing the relationship between an absorbance of sound at 1400 Hz and a distance between two cells in the soundproof structure shown in FIG. 1 and the soundproof structure shown in FIG. 7.

FIGS. 8A and 8B show results in a case where the peak absorbances (maximum absorbances) are investigated by changing the sizes (opening ratios and distances between the two cells) of the opening parts in the soundproof structure 10 in which the opening part is present at the end portion as shown in FIG. 1 and the soundproof structure 10*b* in which the opening part is present in the center as shown in FIG. 7. The examples shown in FIGS. 8A and 8B show changes in peak absorbances in regions in which the distance between the two sound absorbing cells is less than $\lambda/4$ and is equal to or greater than $\lambda/4$, and both the examples shows that the absorption peak frequency showing the peak absorbance is about 1400 Hz. In the graphs of FIGS. 8A and 8B, points indicated by square shapes represent peak absorbances of Examples 1 to 10 of the soundproof structure 10 shown in FIG. 1, as will be described in detail below.

As shown in FIGS. 8A and 8B, it can be seen that it is desirable that the two sound absorbing cells 20*a* and 20*b* which interact with the incident sound waves are arranged so as to be close to each other.

As stated above, in the present invention, the two sound absorbing cells 20*a* and 20*b* need to be adjacent to each other. That is, the two sound absorbing cells 20*a* and 20*b* need to be arranged within a distance with which the sound can cancel each other due to the interference caused by the changes in phases of the two sound absorbing cells 20*a* and 20*b*. The reason can be considered as follows.

The phases of the first sound absorbing cell 20*a* and the second sound absorbing cell 20*b* interfere with each other by changing the phases thereof, and thus, efficiency with which the waves can cancel each other is the best. In a case where there is a distance between the two sound absorbing cells 20*a* and 20*b*, since the phases are changed by the distance, an original phase difference is changed. Thus, it can be seen that the magnitude of the distance between the two sound absorbing cells is associated with the wavelength of the resonance frequency.

Here, assuming that the original phase difference between the two sound absorbing cells is $\Delta\theta$, in a case where the sound absorbing cells are adjacent to each other, the waves interfere with each other with $\Delta\theta$. Assuming that the wavelength of the resonance frequency is $\lambda$, in a case where the two sound absorbing cells are separated with a distance a, the phase difference is $\Delta\theta+a/\lambda$. In the present invention, since the adjustment is performed such that $\Delta\theta$ is $\pi$ (180°), the phase difference is shifted from the cancellation relationship by $a/\lambda$. In a case where a is $\lambda/4$, since the transmitted waves from the sound absorbing cells do not interfere with each other, it can be seen that it is preferable that the distance is less than $\lambda/4$. For example, since $\lambda$ is about 24 cm at 1400 Hz, $\lambda/4$ is about 6 cm.

From the above, in the present invention, assuming that the wavelength at the resonance frequency is $\lambda$, it is preferable that all the first resonant type sound absorbing cells that satisfy a condition the distance between the first resonant type sound absorbing cell and the second resonant type sound absorbing cell closest to the first resonant type sound absorbing cell is less than $\lambda/4$ occupy at least 60% or more of all of the first resonant type sound absorbing cells.

Here, the distance between the two sound absorbing cells is desirably less than $\lambda/4$, more desirably equal to or less than $\lambda/6$, even more desirably equal to or less than $\lambda/8$, and most desirably equal to or less than $\lambda/12$.

The ratio is desirably equal to or greater than 60%, more desirably equal to or greater than 70%, even more desirably equal to or greater than 80%, and most desirably equal to or 90%.

Figure 9:
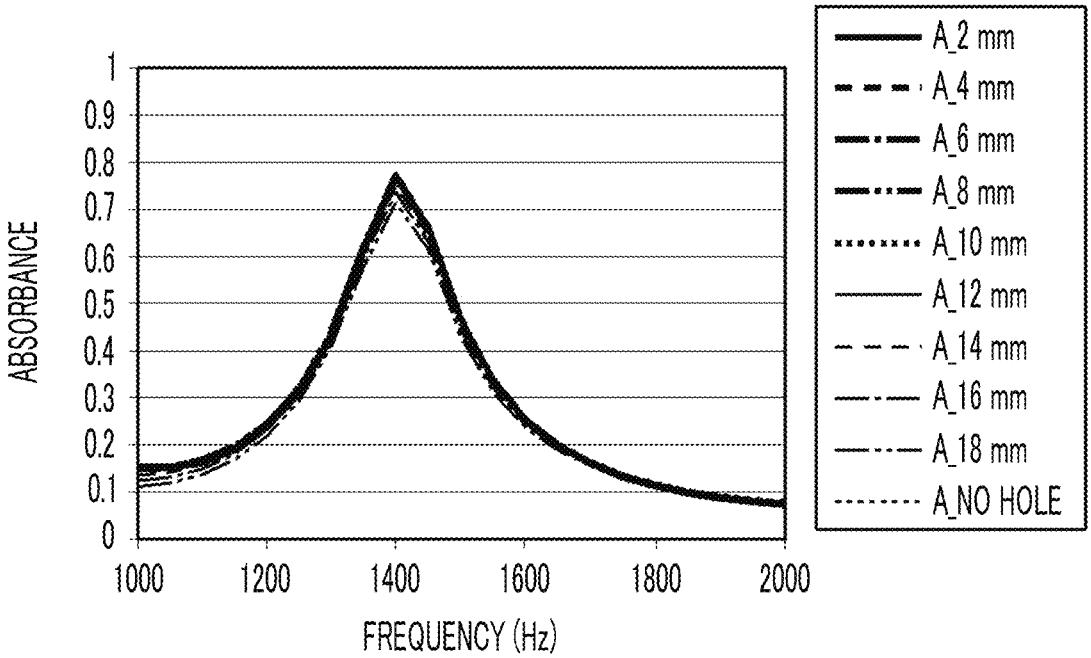
FIG. 9 is a graph showing absorption characteristics of sound in the soundproof structure shown in FIG. 7.
Figure 10:
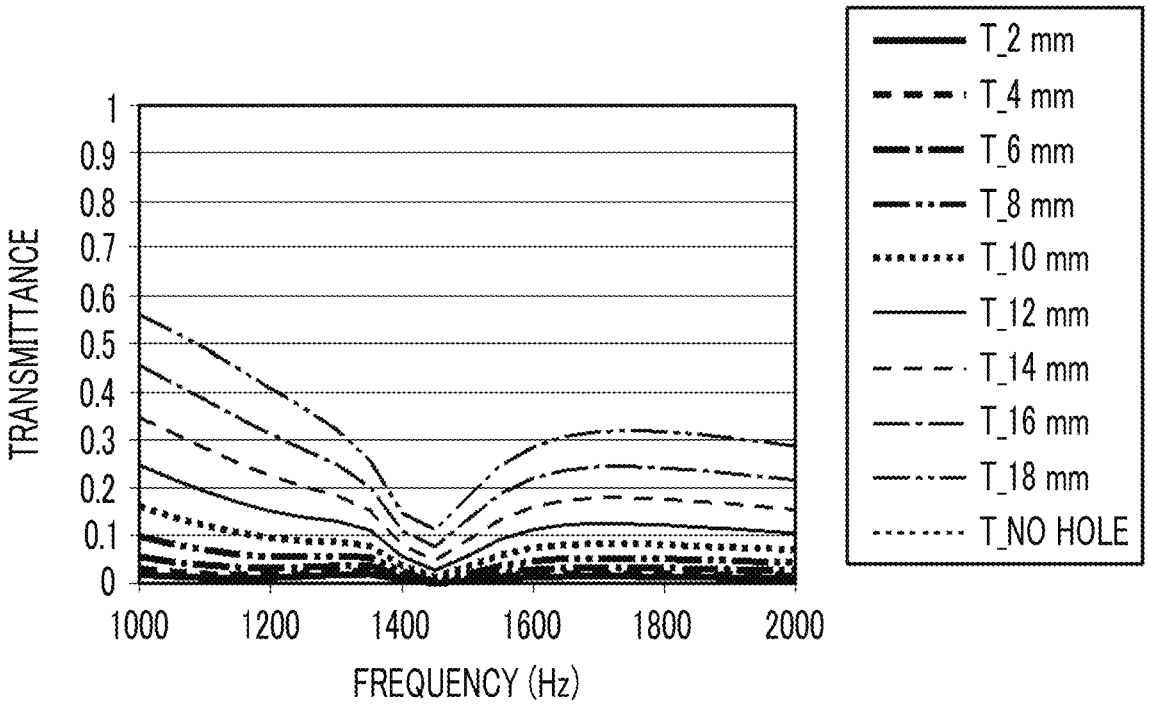
FIG. 10 is a graph showing transmission characteristics of sound in the soundproof structure shown in FIG. 7.

In the soundproof structure 10*b* in which the opening part is present in the center as shown in FIG. 7, absorption characteristics and transmission characteristics of sound within the soundproofing characteristics in a case where the size of the opening part is more finely changed are shown in FIGS. 9 and 10. The amount of changes in these cases is 2 to 18 mm, and a change of less than $\lambda/12$ for the resonance wavelength k is checked.

The soundproof structure 10*b* in which the absorption characteristics and transmission characteristics of the sound shown in FIGS. 9 and 10 are obtained is a structure in which one side is 20 mm and the other side is changed to 2 mm to 18 mm for every 2 mm as the sizes of the first sound absorbing cell 20*a* having the opening 12 of the square of a 20 mm square, the second sound absorbing cell 20*b*, and the rectangle of the opening 12 of the opening cell 22 as the opening part formed therebetween has one side and a structure in which there is no opening part. The frame widths (Lw) of the frames 14 (14*a*, 14*b*, and 14*c*) are 1 mm.

As shown in FIG. 9, it can be seen that the absorbance is not almost changed and the high peak absorbance is not almost changed at the resonance frequency (absorption peak frequency 1420 Hz) even though the opened hole (opening part) is formed between the two sound absorbing cells 20*a* and 20*b* which interact with the incident sound waves. That is, in the soundproof structure 10*b* according to the embodiment of the present invention, it can be seen that the peak absorbance is slightly decreased as the size of the opening part becomes large, but the peak absorbance of 70% or more is demonstrated, and the peak absorbance is not almost changed.

Thus, in the soundproof structure according to the embodiment of the present invention, it is possible to realize a high opening ratio and high absorption.

As shown in FIG. 10, in the soundproof structure 10*b* according to the embodiment of the present invention, it can be seen that the transmittance of the sound is slightly decreased as the size of the opening part becomes small, but a valley (minimum) transmittance of the sound is ten-odd % or lower, is slightly decreased as the size of the opening part becomes smaller, and approaches 0%.

Thus, in the soundproof structure according to the embodiment of the present invention, in a case where the region in which the distance between the two sound absorbing cells is less than $\lambda/2$ is closely looked, since the absorbance is not changed at a high value even though the distance between the two sound absorbing cells is changed in this region, it is possible to realize low transmission, that is, high insulation of sound even though the opening ratio is high.

Although the soundproof structures 10, 10*a*, and 10*b* shown in FIGS. 1, 6, and 7 are the structures including one first sound absorbing cell 20*a*, one second sound absorbing cell 20*b*, and one opening cell 22, the present invention is not limited thereto. The soundproof structures may be structures in which a plurality of soundproof units is combined by using these sound absorbing cells 10, 10*a*, and 10*b* as one soundproof unit.

Figure 11:
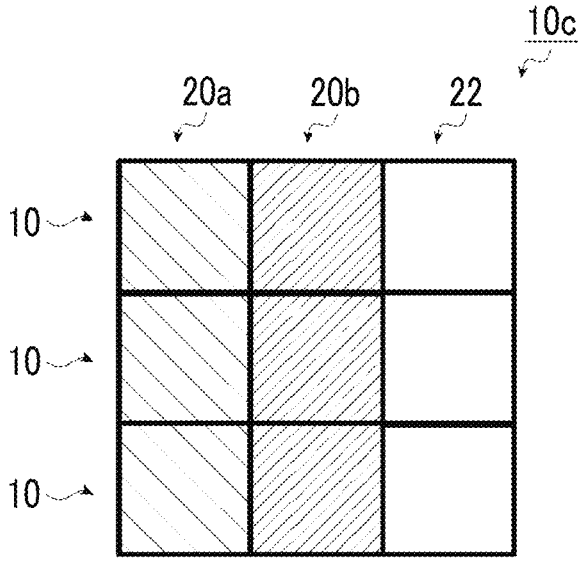
FIG. 11 is a schematic plan view of an example of a soundproof structure according to another embodiment of the present invention.

For example, a structure in which three sets of soundproof structures 10 shown in FIG. 1 are combined may be used as in a soundproof structure 10*c* shown in FIG. 11. A structure in which one set of soundproof structures 10*a* shown in FIG. 6 is combined between two sets of soundproof structures 10 by using two sets of soundproof structures 10 shown in FIG. 1 may be used as in a soundproof structure 10*d* shown in FIG. 12. Both the soundproof structure 10*c* shown in FIG. 11 and the soundproof structure 10*d* shown in FIG. 12 have almost no difference in the soundproofing characteristics.

Although not shown, the soundproof structure according to the embodiment of the present invention may be a structure in which all the soundproof structures 10, 10*a*, and 10*b* shown in FIGS. 1, 6, and 7 are combined, or may be a structure in which two soundproof structures are combined. The number of sets of soundproof structures to be combined is not limited to three sets, and may be two sets or four or more sets.

In the soundproof structure according to the embodiment of the present invention, at least the first resonant type sound absorbing cell and the second resonant type sound absorbing cell which are adjacent to each other, are different from each other, and have the matched resonance frequencies may be used as two kinds or more of resonant type sound absorbing cells. For example, the two kinds of sound absorbing cells 20 which are the frame-film structures including the frames 14 and the films 18 and the opening cell 22 which is the frame structure are provided in the examples of the first embodiment shown in FIGS. 1, 6, and 7. Although it has been described in the present embodiment that the two kinds of sound absorbing cells 20 are the sound absorbing cell 20*a* including the frame 14*a* and the single-layer film 18*a* and the sound absorbing cell 20*b* including the frame 14*b* and the two layers of films 18*b*1 and 18*b*2, the present invention is not limited thereto. Two kinds of sound absorbing cells 20 which are the frame-film structures which include the frames 14 and the films 18, are adjacent to each other, are different from each other, and have the matched resonance frequencies may be used. Hereinafter, the two kinds of sound absorbing cells 20 including the sound absorbing cell 20*a* and the sound absorbing cell 20*b* and the opening cell 22 will be described as the representative examples.

The frame 14 of the sound absorbing cell 20 includes a frame 14*a* constituting the sound absorbing cell 20*a*, a frame 14*b* constituting the sound absorbing cell 20*b*, and a frame 14*c* constituting the opening cell 22. Since these frames have the same configuration, these frames will be described as the frames 14, and these individual frames will be distinguishably described in a case where different cell configurations are described. Hereinafter, the frame is simply referred to as the frame 14 in a case where it is clearly understood that these frames 14 are the frames 14*a* and 14*b* of the sound absorbing cells 20.

The frame 14 is a frame member which is a thick plate-shaped member, and has the opening 12 formed so as to surround in a cyclic shape therein. Here, the frames 14*a* and 14*b* fix the films 18 (18*a*, 18*b*1, and 18*b*2: hereinafter, represented by a reference 18 except for a case where it is necessary to distinguishably describe these films) so as to cover the opening 12 on one side and both sides, and serve as nodes of film vibration of films 18 fixed to these frames 14. Therefore, the frames 14 have higher stiffness than the films 18. Specifically, both the mass and the stiffness of the frame 14 per unit area need to be high.

It is preferable that the shape of the frames 14 (14*a* and 14*b*) has a closed continuous shape capable of fixing the film 18 so as to restrain the entire outer periphery of the film 18. However, the present invention is not limited thereto. The frame 14 may have a discontinuous shape by cutting a part thereof as long as the frame 14 serve as a node of film vibration of the film 18 fixed to the frame 14. That is, since the role of the frame 14 is to fix the film 18 to control the film vibration, the effect is achieved even in a case where there is a small cut in the frame 14 or there is a slightly unbonded part.

The frame 14*c* of the opening cell 22 may be identical to or may be different from the frames 14*a* and 14*b* as long as the opening 12 through which a gas such as heat and/or air can pass can be formed.

For example, the frame 14*c* of the opening cell 22 may be different from the opening cell 22 shown in FIGS. 1, 6, and 7, and may be a duct having a square (square tube) or circular (cylindrical) shape. In this case, a space (interval) between the sound absorbing cells 20*a* and 20*b* arranged within the duct as the frame 14*c* and a duct inner wall is the opening 12 of the opening cell 22.

The shape of the opening 12 formed by the frame 14 is a planar shape. The shape of the opening is a square in the examples shown in FIGS. 1 and 2, but is not particularly limited in the present invention. For example, the shape of the opening 12 may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape. End portions of the frame 14 on both sides of the opening 12 are not closed and but are open to the outside as they are. In the sound absorbing cells 20, the film 18 is fixed to the frame 14 so as to cover the opening 12 at at least one opened end portion of the opened opening 12.

The sizes of the frames 14 are sizes in plan view, and are defined as the sizes of the openings 12. For example, in the case of a regular polygon such as a square shown in FIGS. 1 and 2 or a circle, the size of the frame 14 can be defined as a distance between opposite sides passing through the center or as a circle equivalent diameter. In the case of a polygon, an ellipse, or an irregular shape, the size of the frame 14 can be defined as a circle equivalent diameter. In the present invention, the circle equivalent diameter and the radius are a diameter and a radius at the time of conversion into circles having the same area.

In the soundproof structures 10, 10*a*, and 10*b* according to the embodiment of the present invention, the sizes of the frames 14 to which the films 18 are pasted for each sound absorbing cell 20 may be constant in all the frames 14 or all the frames 14 of the same kind of sound absorbing cells 20, but the frames having different sizes (including the case of the different shapes) may be included. In a case where the frames having different sizes are included, the average size of the frames 14 may be used as the sizes of the frames 14 of the same kind of sound absorbing cells 20.

The sizes of the frames 14 are not particularly limited, and the sizes of the frames may be set according to the soundproofing target to which the soundproof structures 10 and 10*a* to 10*d* (hereinafter, represented by the soundproof structure 10) according to the embodiment of the present invention are applied in order to perform the soundproofing. Examples of the soundproofing target include a copying machine, a blower, air conditioning equipment (air conditioner), an air conditioner outdoor unit, a ventilator, a pump, a generator, a duct, industrial equipment including various kinds of manufacturing equipment capable of emitting sound such as a coating machine, a rotary machine, and a conveyor machine, transportation equipment such as an automobile, a train, an aircraft, ships, bicycles (especially, electric bicycles), and personal mobility, and general household equipment such as a refrigerator, a washing machine, a dryer, a television, a copying machine, a microwave oven, a game machine, an air conditioner, a fan, a PC, a vacuum cleaner, an air purifier, a dishwasher, a mobile phone, a printer, and a water heater, office equipment such a projector, a desktop PC (personal computer), a notebook PC, a monitor, and a shredder; computer equipment using high power such as a server and a super computer; scientific experimental equipment such as a constant-temperature tank, an environmental testing machine, a dryer, an ultrasonic washing machine, a centrifuge, a washing machine, a spin coater, a bar coater, and a conveying machine, and consumer robots (such as cleaning applications, communication applications such as pet-friendly applications and guidance applications, and mobile assistance applications such as automobile chairs) or industrial robots.

The soundproof structure 10 itself can also be used like a partition in order to shield sound from a plurality of noise sources. In this case, the size of the frame 14 can also be selected from the frequency of the target noise. Of course, the structure in which the two kinds of sound absorbing cells 20*a* and 20*b* are integrally or separately arranged within the frame 14*c* which is an outer frame of the partition may be used as the soundproof structure according to the embodiment of the present invention.

It is preferable that the sizes of the frames 14 are decreased in order to obtain the natural vibration mode of the soundproof structure 10 including the frames 14 and the films 18 and the two kinds of sound absorbing cells 20 (20*a* and 20*b*) of the different kinds of frame-film structures on the high frequency side.

It is preferable that the average size of the frames 14 (14*a* and 14*b*) is equal to or less than the wavelength size corresponding to the peak frequency in order to prevent sound leakage due to diffraction at the absorption peak frequency (hereinafter, simply referred to as a peak frequency) of the soundproof structure 10 using the two kinds of sound absorbing cells 20 (20*a* and 20*b*).

For example, the sizes of the frames 14 are not particularly limited, and may be selected according to the sound absorbing cells 20 and the opening cell 22. Regardless of whether the frames 14*a* and 14*b* or the frame 14*c* are used, the sizes of the frames 14 are preferably 0.5 mm to 200 mm, more preferably 1 mm to 100 mm, and most preferably 2 mm to 30 mm. In a case where the frame 14*c* of the opening cell 22 is the duct, the size of the frame 14*c* may be a size capable of arranging the frames 14*a* and 14*b* within the frame 14*c*.

The sizes of the frames 14 may be represented as the average size depending on the kind in a case where the frames 14 have different sizes in the same kind of sound absorbing cells 20 or the opening cell 22.

In addition, the widths (frame widths Lw) and the thicknesses (frame thicknesses Lt) of the frames 14 are not particularly limited as long as the films 18 can be fixed so as to be reliably restrained and accordingly the films 18 can be reliably supported. For example, the widths and thicknesses of the frames may be set depending on the sizes of the frames 14.

The width and thickness of the frame 14*c* are not particularly limited as long as the frame can be combined with the two kinds of sound absorbing cells 20. For example, the width and thickness of the frame may be set depending on the width and thickness of the frame 14*c*.

For example, in a case where the sizes of the frames 14 are 0.5 mm to 50 mm, the widths of the frames 14 are preferably 0.5 mm to 20 mm, more preferably 0.7 mm to 10 mm, and most preferably 1 mm to 5 mm.

In a case where the ratio of the width of the frame 14 to the size of the frame 14 is too large, the area ratio of the portion of the frame 14 with respect to the entire structure increases. Accordingly, there is a concern that the soundproof structure 10 as a device will become heavy. On the other hand, in a case where the ratio is too small, it is difficult to strongly fix the film with an adhesive or the like in the frame 14 portion.

In a case where the size of the frame 14 exceeds 50 mm and is equal to or less than 200 mm, the width of the frame 14 is preferably 1 mm to 100 mm, more preferably 3 mm to 50 mm, and most preferably 5 mm to 20 mm.

In addition, the thickness of the frame 14 is preferably 0.5 mm to 200 mm, more preferably 0.7 mm to 100 mm, and most preferably 1 mm to 50 mm.

It is preferable that the width and the thickness of the frame 14 are expressed by an average width and an average thickness, respectively, for example, in a case where different widths and thicknesses are included in each frame 14.

In the present invention, it is preferable that the frame body 16 arranged so as to connect one-dimensionally or two-dimensionally the plurality of, that is, two or more frames 14, preferably, one frame body 16 is provided.

Figure 12:
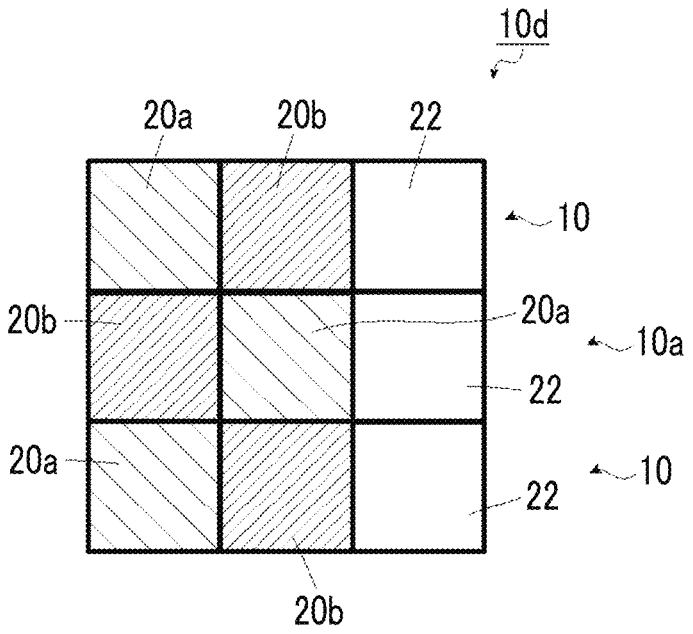
FIG. 12 is a schematic plan view of an example of a soundproof structure according to another embodiment of the present invention.

Here, the number of frames 14 constituting the frame body 16 is three in the examples shown in FIGS. 1, 6, and 7, and the number of frames 14 constituting the frame body 16 is nine in the examples shown in FIGS. 11 and 12. However, the number of frames 14 of the soundproof structure 10 according to the embodiment of the present invention is not particularly limited in the present invention, and may be set according to the soundproofing target of the soundproof structure 10 according to the embodiment of the present invention. Alternatively, since the sizes of the frames 14 are set according to the soundproofing target, the number of frames 14 may be set depending on the sizes of the frames 14.

For example, in the case of noise shielding within the device, the number of frames 14 is preferably 1 to 10000, more preferably 2 to 5000, and most preferably 4 to 1000.

The reason why the preferable number of frames is determined is that since the size of the device is determined for the size of the general device, it is necessary to perform the shielding (that is, reflection and/or absorption) by using the frame body 16 obtained by combining the plurality of sound absorbing cells 20 in order to set the sizes of the pair of sound absorbing cells 20 (20*a* and 20*b*) as the sizes suitable for the frequency of the noise in many cases. The reason why the preferable number of frames is determined is that the entire weight becomes large by the weight of the frames 14 by excessively increasing the number of sound absorbing cells 20. Meanwhile, in the structure such as the partition with no restriction on size, the number of frames 14 can be freely selected depending on the entire size to be required.

Since one sound absorbing cell 20 includes three frames 14 as the constitutional units, the number of frames 14 of the soundproof structure 10 according to the embodiment of the present invention is the sum of the number of sound absorbing cells 20 and the number of opening cells 22.

The materials of the frames 14 or the materials of the frame body 16 are not particularly limited as long as the material can support the films 18, has a suitable strength in the case of being applied to the above soundproofing target, can arrange at least two kinds of sound absorbing cells 20, and is resistant to the soundproof environment of the soundproofing target, and can be selected according to the soundproofing target and the soundproof environment. For example, metal materials such as aluminum, titanium, magnesium, tungsten, iron, steel, chromium, chromium molybdenum, nichrome molybdenum, and copper, and alloys thereof, resin materials such as acrylic resin, methyl polymethacrylate, polycarbonate, polyamideide, polyarylate, polyether imide, polyacetal, polyether ether ketone, polyphenylene sulfide, polysulfone, polyethylene terephthalate, polybutylene terephthalate, polyimide, ABS resin (Acrylonitrile, Butadiene, Styrene copolymer synthetic resin), polypropylene, and triacetyl cellulose, carbon fiber reinforced plastics (CFRP), carbon fibers, and glass fiber reinforced plastic (GFRP) can be used as the materials of the frames 14.

A plurality of materials of the frame 14 may be used in combination.

The present structure may be used by being combined with a porous sound absorbing body. The porous sound absorbing body can be attached to various positions such as an air passage part attached to the frame on the film and a layer in the case of the film structure of two or more layers. The same effect as in a case where there is no porous sound absorbing body is obtained by adjusting the transmission phase with the porous sound absorbing body.

The porous sound absorbing body is not particularly limited, and the known porous sound absorbing body of the related art can be appropriately used. For example, foam materials such as foamed urethane, flexible urethane foam, wood, ceramic particle sintered materials, and phenolic foam and materials including minute air; fibers, such as glass wool, rock wool, microfiber (such as synthrate (trademark) manufactured by 3M), floor mat, carpet, meltblown nonwoven fabric, metal nonwoven fabric, polyester nonwoven fabric, metal wool, felt, insulation board, and glass nonwoven fabric, and nonwoven fabric materials; wood cement board; and nanofiber-based materials such as silica nanofiber; gypsum boards; and various known porous sound absorbing materials can be appropriately used as the porous sound absorbing body.

The films 18 are fixed so as to be restrained by the frame 14 so that the opening 12 inside the frame 14 is covered, and the film 18 absorbs or reflects the energy of sound waves to insulate sound by performing film vibration corresponding to the sound waves from the outside. For this reason, it is preferable that the films 18 are impermeable to air.

Incidentally, since the films 18 need to vibrate with the frame 14 as a node, it is necessary that the film 18 is fixed to the frame 14 so as to be reliably restrained by the frame 14 and accordingly becomes an antinode of film vibration, thereby absorbing or reflecting the energy of sound waves to insulate sound. Therefore, it is preferable that the films 18 are made of a flexible elastic material.

Therefore, the shapes of the films 18 are the shapes of the openings 12 of the frames 14. In addition, the sizes of the films 18 are the sizes of the frames 14. More specifically, the sizes of the films 18 can be the sizes of the openings 12 of the frames 14.

As stated above, the films 18 include two different kinds of films 18*a* and 18*b* of which thicknesses and/or kinds (physical properties such as density and Young's modulus) are different, or of which the sizes such as frame sizes are different, which are pasted to the frames 14.

In the soundproof structures 10, and 10*a* to 10*d* shown in FIGS. 1, 6, 7, 11, and 12, the two different kinds of films 18 (18*a* and 18*b*) fixed to the frames 14 (14*a* and 14*b*) of the two kinds of sound absorbing cells 20 (20*a* and 20*b*) have different first resonance frequencies at which the transmission loss is a minimum value (for example, 0 dB) as the frequencies of the lowest-order natural vibration modes (natural vibration frequencies). Meanwhile, the two films 18*b*1 and 18*b*2 fixed to both sides of the frame 14*b* of the sound absorbing cell 20*b* are the integrated films 18*b*, and have the higher-order (for example, second resonance frequencies) matching with the first resonance frequency of the film 18*a* fixed to one side of the frame 14*a* of the sound absorbing cell 20*a*. Here, the films 18*b* mean the integrated films of the two films 18*b*1 and 18*b*2, but may be considered as the representative of the films 18*b*1 and 18*b*2.

That is, in the present invention, the sound is transmitted at the first resonance frequency of the single-layer film 18*a* of the sound absorbing cell 20*a* and the higher-order (for example, second) resonance frequencies of the integrated films 18*b* (two layers of films 18*b*1 and 18*b*2) of the sound absorbing cell 20*b*. Of course, the opening cell causes the sound to transmit at these frequencies.

Accordingly, in the soundproof structures 10 and 10*a* to 10*d* according to the embodiment of the present invention, for example, the film 18*a* of the sound absorbing cell 20*a* and the two layers of films 18*b*1 and 18*b*2 of the sound absorbing cell 20*b* cause strong film vibration having the same phase at the matched resonance frequencies (the first resonance frequency of the sound absorbing cell 20*a* and the higher-order (second) resonance frequency of the sound absorbing cell 20*b*), and the two layers of films 18*b*1 and 18*b*2 of the sound absorbing cell 20*b* cause the strong film vibration having inverted phases, as shown in FIG. 3. Since the sound absorbing cells are resonating, a real part of acoustic impedance is very close to a value of air, and reflected waves are not almost generated for both the sound absorbing cell 20*a* and the sound absorbing cell 20*b* (a resonance phenomenon is defined as the matching of the acoustic impedance with a medium). Thus, for example, as shown in FIG. 3, since the phases of the sound waves having the first resonance frequency which are transmitted through the film 18*a* of the sound absorbing cell 20*a* and the sound waves having the same resonance frequency which are transmitted through the opening cell 22 are inverted with respect to the phase of the sound waves having the same resonance frequency which are transmitted through the film 18*b*2 of the sound absorbing cell 20*b*, the sound waves cancel each other through the interaction, and the transmitted waves reaching a far filed are reduced. Thus, the reflected waves are reduced due to the resonance phenomenon, and thus, the transmitted waves are reduced due to the cancellation interference. Accordingly, the incident waves are locally present around the films, and are ultimately absorbed by film vibration. Thus, the absorption peak is achieved at the higher-order (second) resonance frequency of the sound absorbing cell 20*b* matched with the first resonance frequency of the sound absorbing cell 20*a*. That is, as shown in FIG. 4, the absorbance is maximized, that is, the absorption peak frequency as the peak of the absorption is obtained at the matched resonance frequencies of the films 18 of the two kinds of sound absorbing cells 20.

The soundproof structure according to the embodiment of the present invention includes the two or more kinds of films of which (physical properties of) sizes, thicknesses, and/or kinds are different, and/or the two or more kinds of frames of which (physical properties of) sizes, widths, thicknesses, and/or kinds are different. In addition to these films and frames, two or more kinds of sound absorbing cells in which the first resonance frequency of one sound absorbing cell and the higher-order resonance frequency of the other sound absorbing cell match each other are provided. Accordingly, the soundproof structure has the absorption peak frequency at which the absorption reaches the peak in the resonance frequencies matched in the two kinds of sound absorbing cells.

The principle of the soundproofing of the soundproof structure according to the embodiment of the present invention having such features can be considered as follows.

Initially, the film surface of the frame-film structure of one kind of sound absorbing cell of the frame-film structures of the two kinds of sound absorbing cells of the soundproof structure according to the embodiment of the present invention has the first resonance frequency which is the frequency at which a film surface resonantly vibrates as described above and the sound waves are greatly transmitted. In contrast, the frame-film structure of the other kind of sound absorbing cell has the higher-order resonance frequency matched with the first resonance frequency of the frame-film structure of the one kind of sound absorbing cell. The first resonance frequency and the higher-order resonance frequency are determined by effective hardness such as the thicknesses of the films, the kinds (physical properties such as density and Young's modulus) of the films, and/or the sizes (the sizes of the openings and the films), widths, and thicknesses of the frames. As the structure becomes hard, the structures have resonance points at the high frequencies.

In a region of the first resonance frequency of the frame-film structure of one kind of sound absorbing cell, the films fixed to the frames vibrate with the same phases, and can behave like capacitors without greatly changing the phases of the sound waves passed through the films at the time. In a region of the higher-order resonance frequency of the frame-film structure of the other kind of sound absorbing cell, the two layers of films are inverted to each other and vibrate, the phases of the sound waves passed through the films at this time are inverted, and the films can behave like inductances. That is, the combination of the two kinds of frame-film structures can be regarded as connecting the capacitors and the impedances (coils) together.

Here, since the sound waves are also wave phenomena, the strengthening or cancellation of the amplitudes of the waves due to the interference is caused. Since the phases of the sound waves having the same phase which are transmitted through the one kind of frame-film structure (sound absorbing cell), the sound waves having the same phase which do not pass through the film and pass through the opening space of the opening part, and the sound waves having the determined phase which are transmitted through the other kind of frame-film structure (sound absorbing cell) are opposite to each other, these sound waves cancel each other. Thus, the sound waves cancel each other in the region of the matched resonance frequencies of the two or more different kinds of frame-film structures (sound absorbing cells). Particularly, the amplitudes of the waves are equal to each other and the phases are inverted at the frequencies at which the amplitudes of the sound waves transmitted through the frame-film structures, and very large absorption is caused.

That is, in a case where the frame-film structures (sound absorbing cells) which are two structures of which effective "hardness" are different are used, for example, the frames are identical to each other and the two kinds of films of which the thicknesses are different and/or two kinds of films of which the physical properties are different are merely pasted, it is possible to realize the absorption of strong sound, that is, strong acoustic absorption, and it is possible to realize strong soundproofing.

This is the principle of the soundproofing of the soundproof structure according to the embodiment of the present invention.

The features of the present invention are to variously select the materials or thicknesses of the films depending on the purpose of use as long as the two or more kinds of frame-film structures (sound absorbing cells) having different hardness may be used. Accordingly, in the soundproof structure according to the embodiment of the present invention, since the films having various characteristics can be used as the films pasted to the frames, it is possible to easily achieve the soundproof structure having a function of combining other physical properties such as flame retardancy, light transmittance, and/or heat insulation or characteristics.

Here, the thicknesses of the films 18 are not particularly limited as long as the films can vibrate by absorbing or reflecting the energy of sound waves to insulate sound even though the thicknesses of the films 18*a* and 18*b* (18*b*1 and 18*b*2) are different from each other. However, it is preferable that the films are thick in order to obtain natural vibration mode on the high frequency side. In the present invention, for example, the thicknesses of the films 18 can be set according to the sizes of the frames 14, that is, the sizes of the films.

For example, in a case where the sizes of the frames 14 are 0.5 mm to 50 mm, the thicknesses of the films 18 are preferably 0.005 mm (5 m) to 5 mm, more preferably 0.007 mm (7 m) to 2 mm, and most preferably 0.01 mm (10 m) to 1 mm.

In a case where the sizes of the frames 14 exceed 50 mm and are equal to or less than 200 mm, the thicknesses of the films 18 are preferably 0.01 mm (10 m) to 20 mm, more preferably 0.02 mm (20 m) to 10 mm, and most preferably 0.05 mm (50 m) to 5 mm.

It is preferable that the thicknesses of the films 18 are expressed by an average thickness in a case where there are different thicknesses in one film 18 or in a case where there are different thickness in the films 18.

Here, in the soundproof structure 10 according to the embodiment of the present invention, the first resonance frequency of the film 18*a* in one frame structure including the frames 14 and the films 18 (18*a* and 18*b*) and the higher-order resonance frequency of the integrated films 18*b* (two layers of films 18*b*1 and 18*b*2) in the other frame structure, which matches the first resonance frequency, can be determined by geometric forms (for example, the shapes and dimensions (sizes) of the frames 14) of the frames 14 of the sound absorbing cells 20 (20*a* and 20*b*), the stiffness (for example, the physical properties such as the thicknesses and flexibility of the films) of the films 18 (18*a* and 18*b*) of the plurality of sound absorbing cells 20, and the distance between the plurality of laminated films.

In the case of the same kind of films 18, a ratio [$a^2/t$] between the thickness (t) of the film 18 and the square of the size (a) (for example, the size of one side in the case of a regular square or the size of a radius in the case of a circle) of the frame 14 can be used as the parameter characterizing the first natural vibration modes of the films 18. Here, in a case where this ratio [$a^2/t$] is equal (for example, a case where (t, a) is (50 μm, 7.5 mm) and a case where (t, a) is (200 μm, 15 mm)), the first natural vibration mode becomes the same frequency (that is, the same first resonance frequency). That is, the ratio [$a^2/t$] has a constant value, and thus, the scale law is established. Accordingly, it is possible to select an appropriate size.

The Young's modulus of the films 18 (18*a* and 18*b*) are not particularly limited as long as the films 18 have elasticity capable of vibrating in order to insulate sound by absorbing or reflecting the energy of sound waves even though the films have different Young's modulus. However, it is preferable to set the Young's modulus to be large in order to obtain natural vibration mode on the high frequency side. For example, the Young's modulus of the films 18 (18*a* and 18*b*) can be set according to the sizes of the frames 14, that is, the sizes of the films 18 in the present invention.

For example, the Young's modulus of the films 18 (18*a* and 18*b*) are preferably 1000 Pa to 3000 GPa, more preferably 10000 Pa to 2000 GPa, and most preferably 1 MPa to 1000 GPa.

The densities of the films are not particularly limited as long as the films can vibrate by absorbing or reflecting the energy of sound waves to insulate sound even though the films 18 (18*a* and 18*b*) are also different. For example, the densities of the films 18 are preferably 10 kg/$m^3$ to 30000 kg/$m^3$, more preferably 100 kg/$m^3$ to 20000 kg/$m^3$, and most preferably 500 kg/$m^3$ to 10000 kg/$m^3$.

In a case where a film-shaped material or a foil-shaped material is used as materials of the films 18, the materials of the films 18 are not particularly limited as long as the material has a strength in the case of being applied to the above soundproofing target and is resistant to the soundproof environment of the soundproofing target so that the films 18 can vibrate by absorbing or reflecting the energy of sound waves to insulate sound, and can be selected according to the soundproofing target, the soundproof environment, and the like. A material or a structure capable of forming a thin structure such as a resin material capable of being formed in a film shape such as polyethylene terephthalate (PET), polyimide, polymethylmethacrylate, polycarbonate, acrylic (PMMA), polyamideide, polyarylate (PAR), polyetherimide (PEI), polyacetal, polyetheretherketone, polyphenylene sulfide (PPS), polysulfone, polyethylene terephthalate, polybutylene terephthalate, polyimide, triacetyl cellulose (TAC), polyvinylidene chloride (PVDC), low-density polyethylene, high-density polyethylene, aromatic polyamide, silicone resin, ethylene ethyl acrylate, vinyl acetate copolymer, polyethylene (PE), chlorinated polyethylene, polyvinyl chloride (PVC), polymethyl pentene (PMP), and polybutene, a metal material capable of being formed in a foil shape such as aluminum, chromium, titanium, stainless steel, nickel, tin, niobium, tantalum, molybdenum, zirconium, gold, silver, platinum, palladium, iron, copper, and permalloy, a material capable of being formed as a fibrous film such as paper and cellulose, nonwoven fabrics, films including nano-sized fibers, porous materials such as thinly processed urethane and synthrate, and carbon materials processed into a thin film structure can be used as the materials of the films 18.

In addition to the metal material, various metals such as 42 alloy, Kovar, nichrome, beryllium, phosphor bronze, brass, nickel silver, tin, zinc, steel, tungsten, lead, and iridium can be used as the materials of the films 18.

In addition to the resin material, resin materials such as cycloolefin polymers (COP), Zeonor, polyethylene naphthalate (PEN), polypropylene (PP), polystyrene (PS), aramid, polyethersulfone (PES), nylon, polyester (PEs), cyclic olefin copolymers (COC), diacetyl cellulose, nitrocellulose, cellulose derivatives, polyamide, polyoxymethylene (POM), and polyrotaxane (such as sliding ring material) can be used as the materials of the films 18.

Glass materials such as thin film glass or fiber reinforced plastic materials such as carbon fiber reinforced plastics (CFRP) and glass fiber reinforced plastics (GFRP) can also be used as the materials of the films 18. Alternatively, these materials may be combined.

In the case of using a metal material, metal plating may be performed on the surface from the viewpoint of suppression of rust and the like.

For example, in a case where at least the films 18*a* and 18*b*1 are identical to each other (that is, a case where the frame 14*a* and the frame 14*b* are different from each other and the film 18*a* and the films 18*b*1 and 18*b*2 are identical to each other or a case where the film 18*a* is different from the film 18*b*2 and is identical to the film 18*b*1), the film 18 may be fixed to the plurality of frames 14 of the frame body 16 of the soundproof structure 10 and may constitute the sheet-shaped film body as a whole. That is, the plurality of films 18 may be constituted by one sheet-shaped film body which covers the plurality of frames 14. Alternatively, the films 18 which cover the frames 14 may be formed as intermediate layers thereof by fixing the sheet-shaped film body to a part of the plurality of frames 14 so as to cover the part of the frames 14.

In addition, the films 18 are fixed to the frames 14 so as to cover an opening on at least one side of the opening 12 of the frames 14. That is, the film 18*a* is fixed to one side or the other side of the opening 12 of the frame 14*a* and the films 18*b*1 and 18*b*2 are fixed to the frame 14*b* so as to cover the opening 12 on both sides.

Here, all the films 18*a* may be provided on the same sides of the openings 12 of the frames 14*a* of the plurality of sound absorbing cell 20*a* of the soundproof structure 10. Alternatively, a part of the films 18*a* may be provided on one side of the openings 12 of the frames 14*a* of the plurality of sound absorbing cells 20*a*, and the remaining part of the films 18*a* may be provided on the other side of the opening 12 of the remaining part of the frames 14*a* of the plurality of sound absorbing cells 20*a*. Alternatively, the films formed on one side and the other sides of the openings 12 of the frames 14*a* of the plurality of sound absorbing cells 20*a* may be present together.

The method of fixing the films 18 to the frames 14 is not particularly limited. Any method may be used as long as the films 18 can be fixed to the frames 14 so as to serve as a node of film vibration. For example, a method using an adhesive, a method using a physical fixture, and the like can be mentioned.

In the method of using an adhesive, an adhesive is applied onto the surfaces of the frames 14 surrounding the opening 12 and the films 18 are placed thereon, so that the films 18 are fixed to the frames 14 with the adhesive. Examples of the adhesive include epoxy based adhesives (Araldite (registered trademark) (manufactured by Nichiban) and the like), cyanoacrylate based adhesives (Aron Alpha (registered trademark) (manufactured by Toagosei) and the like), and acrylic based adhesives.

Similarly to the frame body or the film body, the adhesive can be selected from the viewpoint of heat resistance, durability, and water resistance. For example, various fixing method such as "Super X" series manufactured by CEMEDINE, "3700 series (heat resistant)" manufactured by ThreeBond, "Duralco series" which is heat resistant epoxy adhesive and is manufactured by Solar Wire Net, 9077 which is a double-sided tape, is a high heat resistant double-sided pressure-sensitive adhesive tape, and is manufactured by 3M can be selected for required characteristics.

As a method using a physical fixture, a method can be mentioned in which the films 18 disposed so as to cover the openings 12 of the frames 14 is interposed between the frames 14 and a fixing member, such as a rod, and the fixing member is fixed to the frames 14 by using a fixture, such as a screw or a small screw.

Incidentally, in the soundproof structure 10 according to the embodiment of the present invention, the first natural vibration frequency is determined by the structure including the frames 14 and the films 18.

As stated above, in the case of the same kind of films 18, a ratio [$a^2/t$] between the thickness (t) of the film 18 and the square of the size (a: circle equivalent radius or square equivalent side) of the frame 14 can be used as the parameter characterizing the first natural vibration modes of the films 18.

Figure 22:
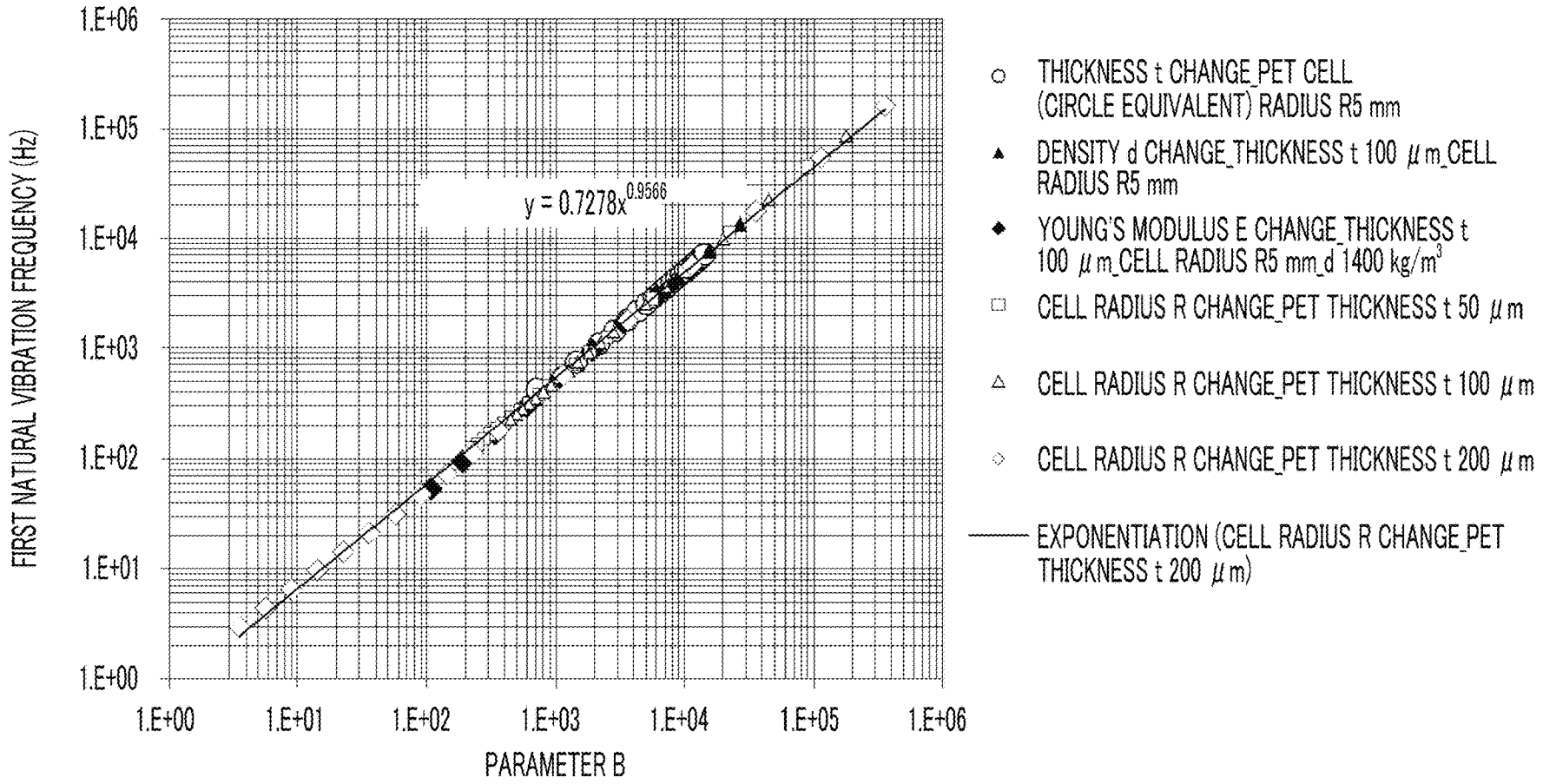
FIG. 22 is a graph showing a first natural vibration frequency for a parameter B of the soundproof structure according to the embodiment of the present invention.

Therefore, the present inventors have found out that assuming that the size (circle equivalent radius) of the frame 14 (14*a*) of the soundproof cell 20 (20*a*) is a(m), the thickness of the film 18 (18*a*) is t (m), the Young's modulus of the film 18 is E (Pa), and the density of the film 18 is d ($kg/m^3$), the parameter B (√m) is expressed by the following expression (1) in the soundproof structure 10 according to the embodiment of the present invention. The present inventors have found out that the parameter B (gym) and the first natural vibration frequency (Hz) of the soundproof cell 20 which is the structure including the frames 14 and the films 18 of the soundproof structure 10 have a substantially linear relationship even though the circle equivalent radius a (m) of the soundproof cell 20, the thickness t (m) of the film 18, the Young's modulus E (Pa) of the film 18, and the density d ($kg/m^3$) of the film 18 are changed. The present inventors have found out that the parameter B (√m) and the first natural vibration frequency (Hz) are expressed by an expression expressed by the following Expression (2) as shown in FIG. 22.

$$B=t/a^2*\sqrt{(E/d)} \quad (1)$$

$$y=0.7278x^{0.9566} \quad (2)$$

Here, y is the first natural vibration frequency (Hz), and x is the parameter B.

FIG. 22 shows values obtained from the result of a simulation in a design stage before experiments of Examples to be described below.

From the above, it can be seen in the soundproof structure 10 according to the embodiment of the present invention that points representing the relationship between the parameter B and the first natural vibration frequency (Hz) of the soundproof cell 20 are expressed by the following Expression (2) regarded as the substantially linear expression and all the points are present in the substantially same straight line in two-dimensional (xy) coordinates by standardizing the circle equivalent radius a (m) of the soundproof cell 20, the thickness t (m) of the film 18, the Young's modulus E (Pa) of the film 18, and the density d ($kg/m^3$) of the film 18 as the parameter B (√m).

Values of the parameter B for a plurality of values of the first natural vibration frequency from 10 Hz to 100000 Hz are represented in Table 2.

TABLE 1

| Frequency (Hz) | B parameter |
|---|---|
| 10 | 1.547 × 10 |
| 20 | 3.194 × 10 |
| 40 | 6.592 × 10 |
| 100 | $1.718 \times 10^2$ |
| 12000 | $2.562 \times 10^4$ |
| 16000 | $3.460 \times 10^4$ |
| 20000 | $4.369 \times 10^4$ |
| 100000 | $2.350 \times 10^5$ |

As can be clear from Table 1, since the parameter B corresponds to the first natural vibration frequency, the parameter is preferably 1.547×10 (=15.47) or more and $2.350\times10^5$ (235000) or less, more preferably 3.194×10 (=31.94) to $4.369\times10^4$ (43690), even more preferably 6.592×10 (=65.92) to $3.460\times10^4$ (34600), and most preferably $1.718\times\times 10^2$ (=171.8) to $2.562\times10^4$ (25620).

Due to the use of the parameter B standardized as above, it is possible to determine the first natural vibration frequency as an upper limit of a high frequency side of a shielding peak frequency in the soundproof cell (first soundproof cell) of the soundproof structure according to the embodiment of the present invention. In contrast, due to the use of the parameter B, it is possible to set the soundproof structure according to the embodiment of the present invention having the first natural vibration frequency which is capable of having the shielding peak frequency which is the center of the frequency band in which the sound is to be selectively insulated.

The soundproof structure according to the first embodiment of the present invention is basically configured as described above.

Although it has been described in the examples shown in FIGS. 1, 6, and 7 that the soundproof structures 10, 10*a*, and 10*b* according to the embodiments of the present invention are constituted by combining the first sound absorbing cell 20*a*, the second sound absorbing cell 20*b*, and the opening cell 22, the present invention is not limited thereto. The soundproof structure according to the embodiment of the present invention may be the structure using the second sound absorbing cell including the two layers of plates each having the through-hole instead of the second sound absorbing cell 20*b* including the two layers of films 18*b* (18*b*1 and 18*b*2).

Second Embodiment

Figure 13:
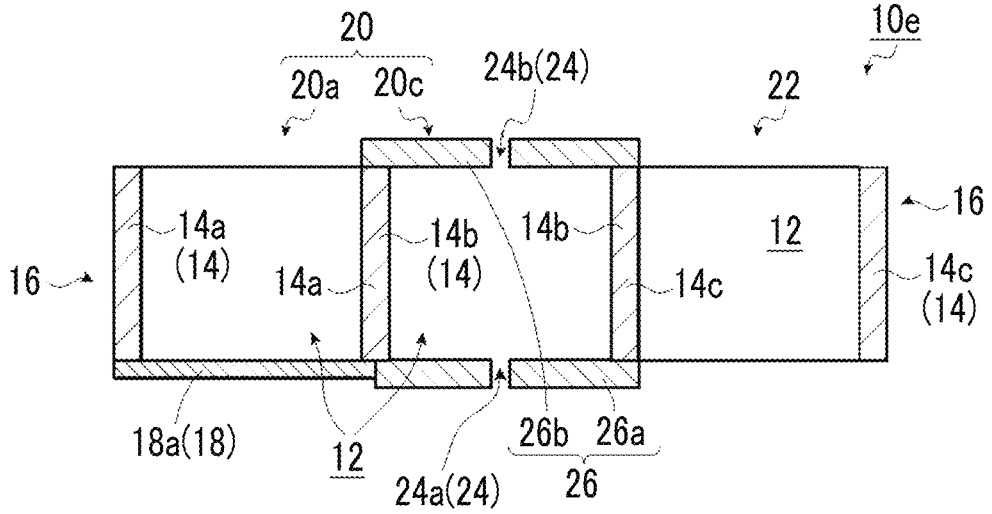
FIG. 13 is a schematic cross-sectional view of an example of a soundproof structure according to another embodiment of the present invention.

FIG. 13 is a schematic cross-sectional view showing an example of a soundproof structure according to a second embodiment of the present invention.

A soundproof structure 10*e* of the second embodiment shown in FIG. 13 is a structure using a second sound absorbing cell 20*c* instead of the second sound absorbing cell 20*b* of the soundproof structure 10 of the first embodiment shown in FIG. 1 and has the same configuration as that of the first embodiment except for the second sound absorbing cell 20*c*. The same constituent elements will be assigned the same references, and the description thereof will be omitted.

The soundproof structure 10*e* of the present embodiment is a structure in which the first sound absorbing cell 20*a*, the second sound absorbing cell 20*c*, and the opening cell 22 are combined.

Here, the first sound absorbing cell 20*a* and the second sound absorbing cell 20*c* function the first resonant type sound absorbing cell and the second resonant type sound absorbing cell of the present invention, respectively. A first resonance frequency of the first sound absorbing cell 20*a* and a higher-order (preferably, second) resonance frequency of the second sound absorbing cell 20*c* match each other. Accordingly, similarly to the sound absorbing cell 20*a* and the sound absorbing cell 20*b*, the sound absorbing cell 20*a* and the sound absorbing cell 20*c* are described as the sound absorbing cells 20 in a case where it is not necessary to distinguish these cells from each other.

The second sound absorbing cell 20*c* comprises a frame 14*b* which has an opening 12 and two layers of plates (perforated plates) 26 (26*a* and 26*b*) which respectively comprise through-holes 24, are fixed around the opening 12 of the frame 14*b*, and cover both end portions of the opening 12.

Although the second sound absorbing cell 20*c* includes two layers of perforated plates 26 (26*a* and 26*b*) which cover both the end portions of the opening 12 in the example shown in FIG. 13, the present invention is not limited thereto. In the present invention, as long as the perforated plates are fixed around the opening 12 of the frame 14*b*, cover the opening 12, and have the through-holes 24, the number of perforated plates may be three layers or more. That is, the second sound absorbing cell 20*c* of the present embodiment may include a multiple-layer (perforated) plates which are at least two layers.

The second sound absorbing cell 20*c* shown in FIG. 13 includes through-holes 24*a* and 24*b* respectively formed in both the perforated plates 26*a* and 26*b* respectively fixed to both the end portions of the opening 12 of the frame 14*b*. Therefore, since the other plate (for example, the perforated plate 26*b*) is not closed with respect to the one plate (for example, the through-hole 24*a* of the perforated plate 26*a*), the through-holes 24*a* and 24*b* are not complete Helmholtz resonance holes. However, since both the plates are connected to the outside by using only the through-holes 24, an air layer confined by both the perforated plates 26 acts like an air spring, and thus, a resonance similar to the same resonance (that is, Helmholtz resonance) as the Helmholtz resonance occurs. On the outside of the through-hole 24*a* of the perforated plate 26*a* and the through-hole 24*b* of the perforated plate 26*b* of the second sound absorbing cell 20*c*, a resonance (hereinafter, referred to as a Helmholtz type resonance in the present invention) which is similar to the Helmholtz resonance and vibrates with inverted phases occur in the sound waves.

That is, the perforated plate 26*a* having the through-hole 24*a* and the perforated plate 26*b* having the through-hole 24*b* integrally act on the sound waves. The sound waves having the resonance frequency which are incident on the through-hole (for example, the through-hole 24*a* of the perforated plate 26*a*) of the one plate resonate due to the Helmholtz type resonance, and the sound waves having the resonance frequency which are emitted from the through-hole (for example, the through-hole 24*b* of the perforated plate 26*b*) of the other plate resonate with inverted phases due to the Helmholtz type resonance.

Here, since the through-hole 24*a* of the perforated plate 26*a* and the through-hole 24*b* of the perforated plate 26*b* communicatively connect an inner space and an outer space of the second sound absorbing cell 20*c* to each other, these through-holes constitute a part of the opening part of the present invention. That is, in the present embodiment, the opening part of the present invention includes the opening 12 of the opening cell 22, and the through-holes 24*a* and 24*b* that communicatively connect the inner and outer spaces of the second sound absorbing cell to each other.

The perforated plate 26 is used in the sound absorbing cell 20*c* of the soundproof structure 10*e* shown in FIG. 13. In the illustrated example, the through-holes 24 serving as the Helmholtz type resonance holes for pseudo Helmholtz resonance are perforated in the approximately central portions of the perforated plates 26.

Here, the perforated plate 26*a* has the through-hole 24*a*, and forms a space formed in a rear surface of the perforated plate 26*a* by the frame 14*c* and the other perforated plate 26*b* except for the through-hole 24*a* as a pseudo closed space closed except for the through-hole 24*b* of the perforated plate 26*b*. In contrast, the perforated plate 26*b* has the through-hole 24*b*, and forms a space formed in a rear surface of the perforated plate 26*b* by the frame 14*c* and the other perforated plate 26*a* except for the through-hole 24*b* as a pseudo closed space closed except for the through-hole 24*a* of the perforated plate 26*a*.

Since such perforated plates 26 can cause a sound absorbing action due to the Helmholtz type resonance similar to the Helmholtz resonance by communicatively connecting the pseudo closed spaces of the rear surfaces with outside air by using the through-holes 24 as the resonance holes, there is no need for film vibration as in the films 18*b* of the sound absorbing cell 20*b* shown in FIG. 1. Accordingly, the perforated plates 26 may be members having stiffness higher than or thicknesses thicker than the films 18*b* of the sound absorbing cell 20*b* shown in FIG. 1.

Thus, the same plate materials as the aforementioned materials of the frames 14 such as a metal material such as aluminum or a resin material such as plastic can be used as the materials of the perforated plates 26 as long as the sound absorption due to the film vibration is not caused. The perforated plates are members having stiffness lower than or thicknesses thinner than the materials of the frames 14.

Although the perforated plates 26 are used in the example shown in FIG. 13, the present invention is not limited thereto. As long as the sound absorption effect due to the Helmholtz type resonance can be caused, the perforated plates may be films having through-holes made of film materials. As the films used for the sound absorbing cell 20*c* used as the Helmholtz type soundproof cell, the same film materials as the film materials of the films 18*b* of the sound absorbing cell 20*b* shown in FIG. 1, which is the vibration film type soundproof cell described above, can be used as long as the sound absorption due to the film vibration is smaller than the sound absorption due to the Helmholtz type resonance at the Helmholtz resonance frequency or as long as the sound absorption due to the film vibration is not caused. However, the films used for the sound absorbing cell 20*c* needs to be films having stiffness higher than or thicknesses thicker than the materials of the films 18*b* of the sound absorbing cell 20*b*.

In a case where the films having the through-holes are used as the sound absorbing cell 20*c* which is the Helmholtz type soundproof cell, the resonance frequency of the Helmholtz type resonance becomes the high frequency side and interferes with the film vibration in a case where the thicknesses of the films are thin. For this reason, it is preferable to use the perforated plates 26 made of plate materials.

The method of fixing the perforated plates 26 or the films having the through-holes to the frames 14*b* is not particularly limited as long as the pseudo closed space can be formed in the rear surfaces of the perforated plates 26 or the films having the through-holes, and the same method as the above-described method of fixing the films 18 to the frames 14 may be used.

Here, as shown in FIG. 13, one or two or more through-holes 24 perforated in the perforated plates 26 may be perforated in the perforated plate 26 that covers the opening 12 of the frame 14*b*. As shown in FIG. 13, the perforation positions of the through-holes 24 may be the middle of the perforated plates 26. However, the present invention is not limited thereto, and the perforation positions of the through-holes do not need to be the middle of the perforated plates 26, and the through-holes may be perforated at any positions.

That is, the sound absorbing characteristics of the sound absorbing cell 20*c* are not changed by simply changing the perforation positions of the through-holes 24.

Although it has been described in the example shown in FIG. 13 that the through-hole 24*a* of the perforated plate 26*a* and the through-hole 24*b* of the perforated plate 26*b* are formed in the same positions in order to facilitate the passage of air as wind from the viewpoint of air permeability, the present invention is not limited thereto.

The number of through-holes 24 in the perforated plates 26 may be one. However, the present invention is not limited thereto, and two or more (that is, a plurality of) through-holes may be formed.

Here, in the sound absorbing cell 20*c*, it is preferable that the through-holes 24 perforated in the two perforated plates 26 are constituted by one through-hole 24 from the viewpoint of air permeability. The reason is that, in the case of a fixed opening ratio, the easiness of passage of air as wind is large in a case where one hole is large and the viscosity at the boundary does not work greatly.

In the present embodiment, the opening ratios (area ratios) of the through-holes 24 within the perforated plate 26 are not particularly limited, and may be appropriately set according to the sound absorbing characteristics. The opening ratios (area ratios) of the through-holes 24 in the films 18 are preferably 0.01% to 50%, more preferably 0.05% to 30%, and even more preferably 0.10% to 10%. By setting the opening ratios of the through-holes 24 within the above range, it is possible to appropriately adjust the sound absorption peak frequency, which is the center of the soundproofing frequency band to be selectively soundproofed.

In the present invention, it is preferable that the through-holes 24 are perforated using a processing method for absorbing energy, for example, laser processing, or it is preferable that the through-holes 24 are perforated using a mechanical processing method based on physical contact, for example, punching or needle processing.

Therefore, in a case where one through-hole 24 or a plurality of through-holes 24 of the perforated plates 26 has the same size, in the case of perforating holes by laser processing, punching, or needle processing, it is possible to continuously perforate holes without changing the setting of a processing apparatus or the processing strength.

The size of the through-holes 24 may be any size as long as the through-holes can be appropriately perforated by the above-described processing method, and is not particularly limited.

However, from the viewpoint of processing accuracy of laser processing such as accuracy of a laser diaphragm, processing accuracy of punching processing or needle processing, or manufacturing suitability such as easiness of processing, the sizes of the through-holes 24 on the lower limit side may be equal to or greater than 2 μm. However, in a case where the sizes of the through-holes 24 are too small, since the transmittance of the through-holes 24 is too low, so that the sound is not incident before the friction occurs and the sound absorption effect cannot be sufficiently obtained. For this reason, it is preferable that the sizes, that is, diameters of the through-holes 24 are 0.25 mm or more.

On the other hand, since the upper limit of the size (diameter) of the through-hole 24 needs to be smaller than the size of the frame 14*b*, the upper limit of the size of the through-hole 24 may be set to be less than the size of the frame 14*b*.

In the present invention, since the size of the frame 14*b* is preferably 0.5 mm to 200 mm, the upper limit of the size (diameter) of the through-hole 24 is also less than 200 mm. However, in a case where the through-hole 24 is too large, the size (diameter) of the through-hole 24 is too large and the effect of the friction occurring at the end portion of the through-hole 24 is reduced. Therefore, even in a case where the size of the frame 14*b* is large, it is preferable that the upper limit of the size (diameter) of the through-hole 24 is mm order. Since the size of the frame 14*b* is usually mm order, the upper limit of the size (diameter) of the through-hole 24 is also mm order in many cases.

Since the through-holes 24 need to function as the resonance hole causing the absorption action in the Helmholtz type resonance, the size of the through-holes 24 needs to cause the attraction action due to the Helmholtz type resonance. Accordingly, the size of the through-hole 24 is preferably equal to or greater than the diameter of 0.25 mm at which the Helmholtz type resonance occurs. The upper limit needs to be less than the size of the frame 14, but is more preferably 10 mm or less, even more preferably 5 mm or less.

From the above, the size of the through-hole 24 is preferably a diameter of 0.25 mm to 10 mm, more preferably a diameter of 0.3 mm to 10 mm, and most preferably a diameter of 0.5 mm to 5 mm.

As stated above, the soundproof structure 10*e* according to the embodiment of the present invention comprises the first sound absorbing cell 20*a*, the second sound absorbing cell 20*c*, and the opening cell 22. However, the first resonance frequency of the first sound absorbing cell 20*a* and the higher-order resonance frequency of the second sound absorbing cell 20*c* match each other, and thus, the maximum absorbance of the sound in the specific frequency is demonstrated. For example, as will be described below, the soundproof structure 10*e* in which the first sound absorbing cell 20*a*, the second sound absorbing cell 20*c*, and the opening cell 22 are arranged so as to be adjacent to each other as shown in FIG. 13 demonstrates the maximum absorbance of the sound at the maximum absorption frequency of 1450 Hz in the soundproofing characteristics of Example 11 shown in FIG. 14 and at the maximum absorption frequency of 1440 Hz in the soundproofing characteristics of Example 12 shown in FIG. 15. In other words, as shown in FIGS. 14 and 15, in the soundproof structure 10*e* of Examples 11 and 12, the maximum absorption frequencies are respectively 1450 Hz and 1440 Hz.

Figure 14:
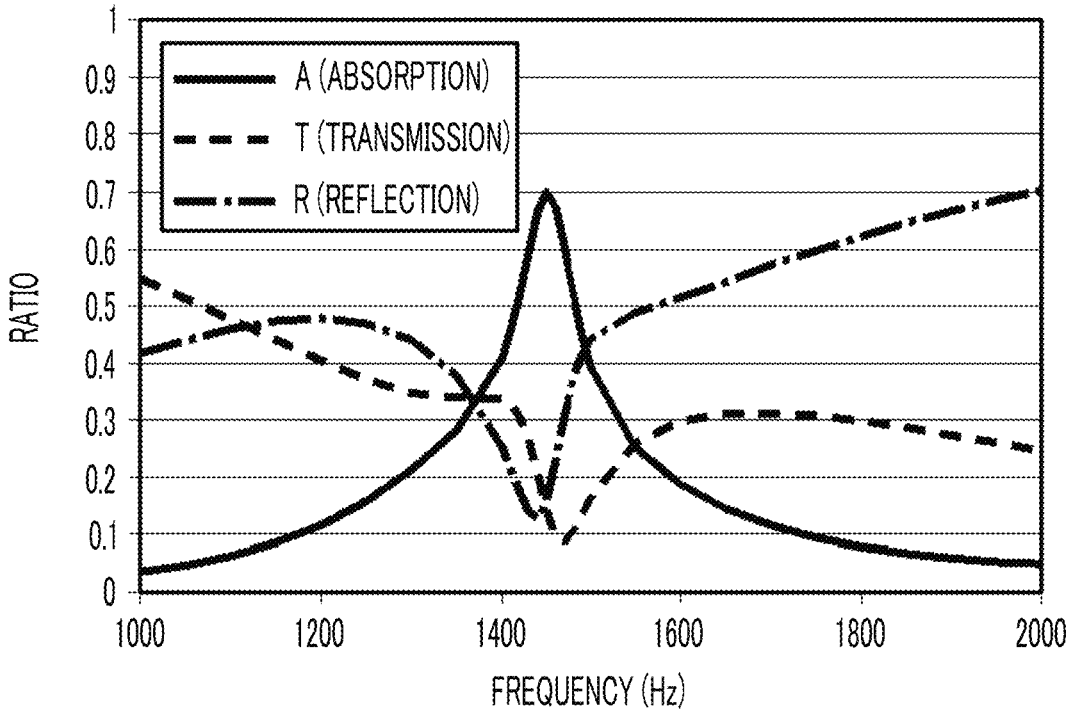
FIG. 14 is a graph showing soundproofing characteristics of Example 11 of the soundproof structure shown in FIG. 13.
Figure 15:
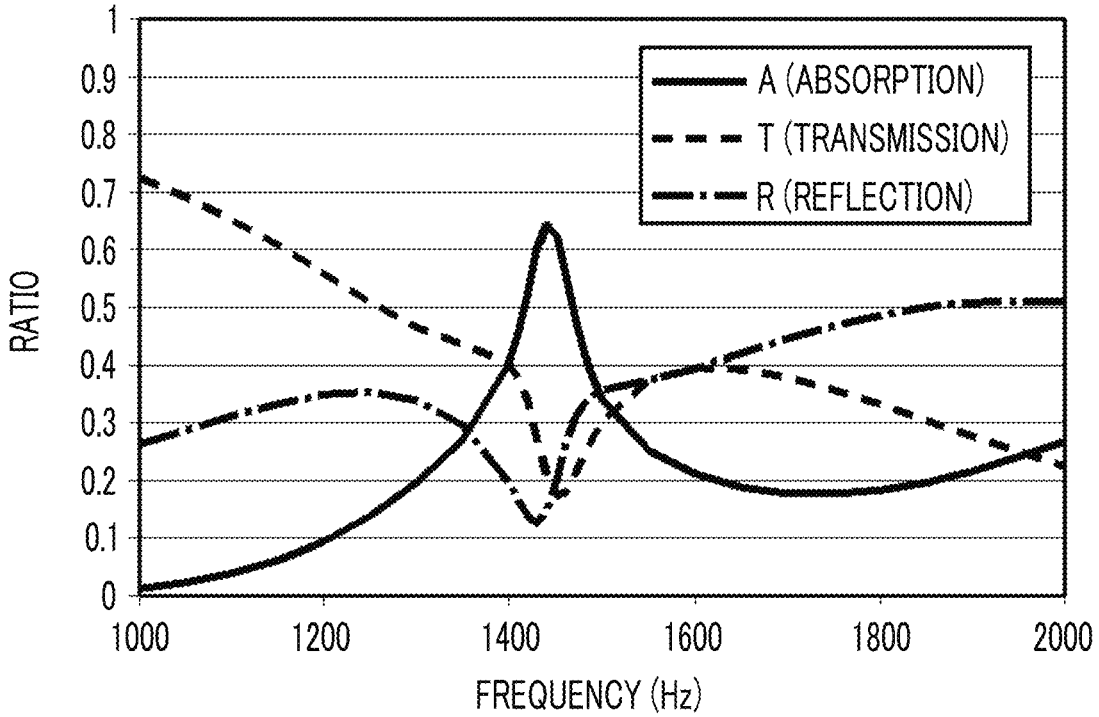
FIG. 15 is a graph showing soundproofing characteristics of Example 12 of the soundproof structure shown in FIG. 13.

As shown in FIGS. 14 and 15, it can be seen that the absorbance of more than 50% is maintained even though the large opening 12 of the opening cell 22 is provided in addition to the through-holes 24*a* and 24*b* as the Helmholtz type resonance holes.

At this time, the maximum absorption frequency can be substantially equal to the frequency matched in the first sound absorbing cell 20*a* and the second sound absorbing cell 20*c*. In addition to the absorbance, the transmittance T and the reflectance R are also shown as the soundproofing characteristics in FIGS. 14 and 15.

Figure 16:
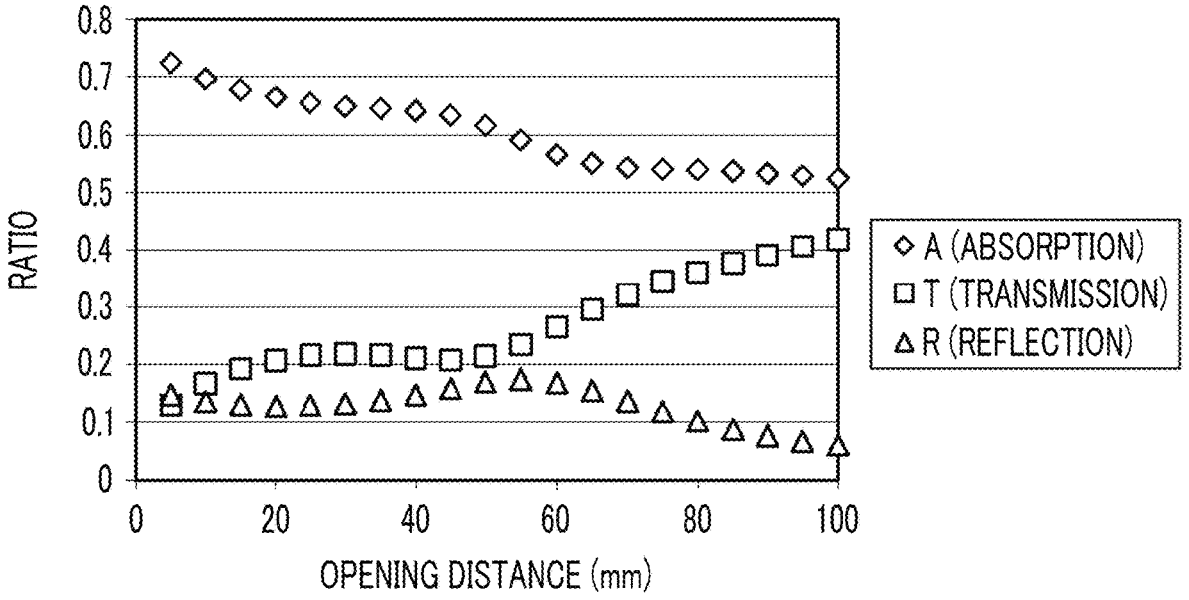
FIG. 16 is a graph showing a change in soundproofing characteristics caused by an opening distance of the opening part of the soundproof structure shown in FIG. 13.
Figure 17:
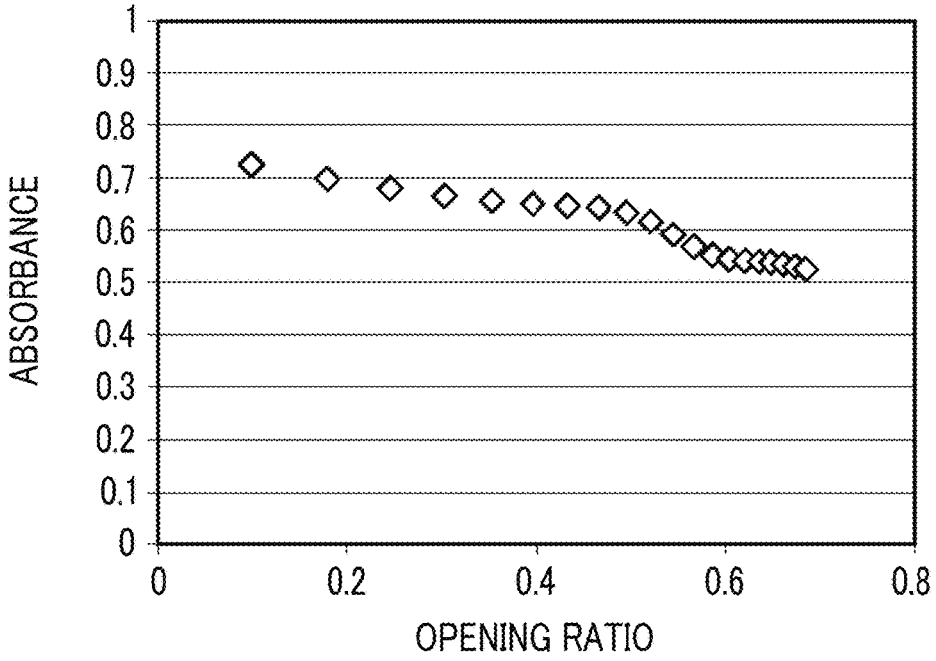
FIG. 17 is a graph showing the relationship between an absorbance of sound and an opening ratio in the soundproof structure shown in FIG. 13.

In the soundproof structure 10*e* shown in FIG. 13, the results obtained by investigating changes in peak absorbance (maximum absorbance) while changing the size of the opening part (an opening distance (mm) and an opening ratio of the opening 12 of the opening cell 22) are shown in FIGS. 16 and 17. As will be described below, points represented by diamond shapes in the graph of FIG. 16 include the peak absorbances A in Examples 11 and 12 of the soundproof structure 10*e* shown in FIG. 13. Since the opening distances of the openings 12 of the opening cells 22 in Examples 11 and 12 are 20 mm and 40 mm, the peak absorbances A represented by the diamond shapes, the valley (minimum) transmittance T represented by the square shapes, and the valley (minimum) reflectances R in a case where the opening distance of the opening 12 of the opening cell 22 in the configuration of Example 11 is changed to 5 mm to 100 mm for every 5 mm are shown in FIG. 16.

The peak absorbances A represented by the diamond shapes in FIG. 16 are in FIG. 17 in which a horizontal axis is converted from the opening distances to the opening ratios. The absorbances shown in FIG. 17 are shown by converting the opening distances of the opening 12 of the opening cell 22 for 20 points of the peak absorbances A represented by the diamond shapes in FIG. 16 to the opening ratios expressed as a ratio of an area of the opening 12 of the opening cell 22 and the through-hole 24*a* (or 24*b*) to a surface area of the soundproof structure 10*e*.

As shown in FIGS. 16 and 17, it can be seen that the absorption characteristics during vibration due to the Helmholtz type resonance exceed 50% and the absorbance is maintained in a high state even though the opening part becomes large by further adding the through-hole 24*a* (or 24*b*) to the large opening 12 of the opening cell 22.

In the second embodiment, the arrangement of the first sound absorbing cell 20*a*, the second sound absorbing cell 20*c*, and the opening cell 22 of the soundproof structure 10*e* may be changed as in the soundproof structures 10*a* and 10*b* shown in FIGS. 6 and 7 of the first embodiment.

Figure 18:
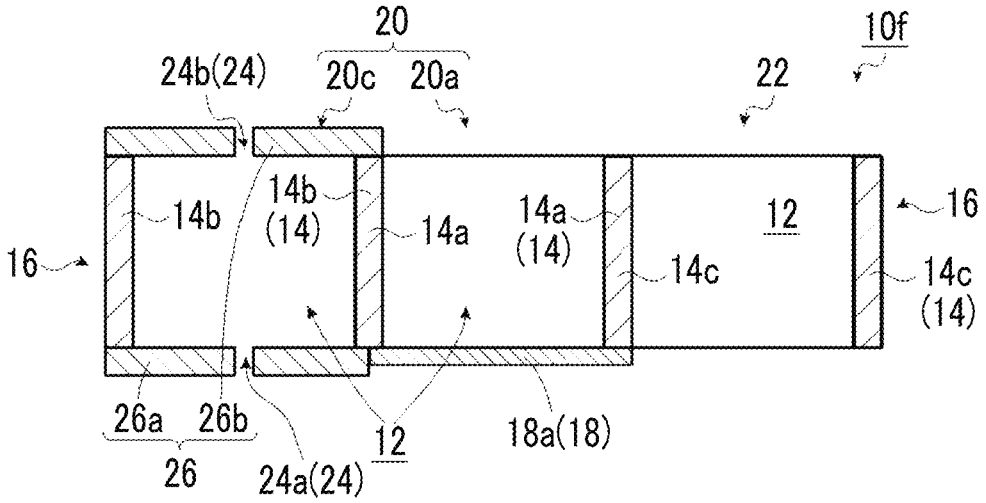
FIG. 18 is a schematic cross-sectional view of an example of a soundproof structure according to another embodiment of the present invention.

FIG. 18 shows a soundproof structure 10*f* which is a structure in which the arrangement of the first sound absorbing cell 20*a* and the second sound absorbing cell 20*c* of the soundproof structure 10*e* shown in FIG. 13 is changed. Since a difference between the soundproof structure 10*f* shown in FIG. 18 and the soundproof structure 10*e* shown in FIG. 13 is the same as the difference between the soundproof structure 10 shown in FIG. 1 and the soundproof structure 10*a* shown in FIG. 6, the description thereof will be omitted.

In the present embodiment, although not shown, the opening cell 22 may be arranged between the first sound absorbing cell 20*a* and the second sound absorbing cell 20*c*, as in the soundproof structure 10*b* shown in FIG. 7.

Figure 19:
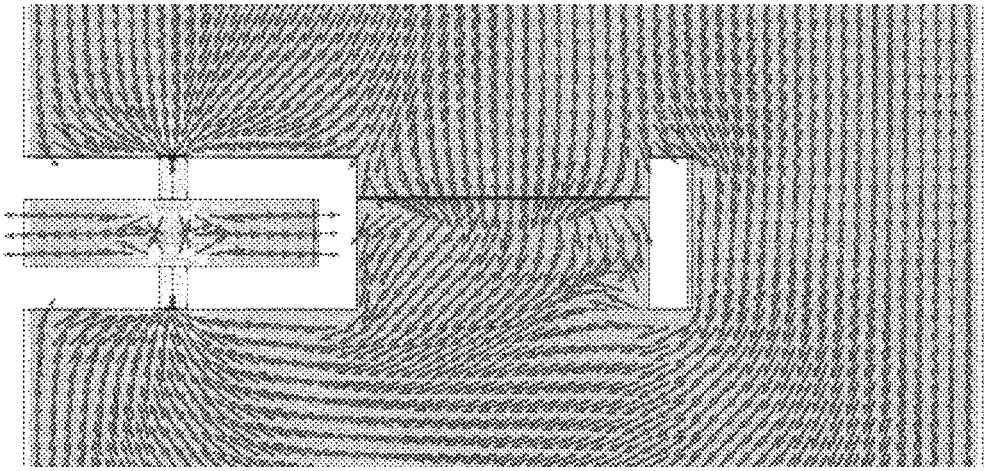
FIG. 19 is a schematic diagram showing a local velocity in film displacement of the soundproof structure shown in FIG. 18.

Similarly to FIG. 3, FIG. 19 shows a local velocity of a film displacement caused in a case where the sound waves are incident on the soundproof structure 10*f* in directions represented by arrows, that is, from the bottom of FIG. 18.

It can be seen from the local velocity of the film displacement of FIG. 19 that a large vibration state is generated in the central portion of the film 18*a* due to the displacement of the film of the normal first resonance frequency mode, that is, the incidence sound pressure in the sound absorbing cell 20*a* including the film 18*a* as one layer (single layer). It can be seen that air on the outside of the through-hole 24*a* of the perforated plate 26*a* and the through-hole 24*b* of the perforated plate 26*b* moves to an opposite direction due to the incidence sound pressure and the resonance due to the Helmholtz type resonance of the resonant mode occurs in the sound absorbing cell 20*c* including the two layers of perforated plates 26*a* and 26*b*. This can be described as follows. As shown in FIG. 19, in the sound absorbing cells 20*a* and 20*c*, the film 18*a* is pressed due to the incidence sound pressure, and air is pushed into the through-hole 24*a* of the perforated plate 26*a*. However, in the sound absorbing cell 20*c*, the phase of the sound waves is inverted on the emission side of the sound waves, that is, a side opposite to the direction in which the sound waves are incident, and the waves transmitted through the film 18*a* and the waves due to the Helmholtz type resonance which are transmitted through the through-hole 24*b* interfere with each other between the film 18*a* and the through-hole 24*b* of the perforated plate 26*b*. It can be seen from FIG. 19 that the waves transmitted through the film 18*a* of the sound absorbing cell 20*a* and the sound waves transmitted through the opening cell 22 are attracted to the through-hole 24*b* of the perforated plate 26*b* of the sound absorbing cell 20*c*, the phases thereof are inverted and incident on the through-hole 24*b* of the perforated plate 26*b* of the sound absorbing cell 20*c*, the transmitted waves and the sound waves transmitted through the through-hole 24*b* cancel each other, and the transmitted waves are reduced.

That is, the first resonance frequency of the film 18*a* as one layer of the sound absorbing cell 20*a* and the higher-order resonance frequencies of the through-hole 24*a* of the perforated plate 26*a* and the through-hole 24*b* of the perforated plate 26*b* as two layers of the sound absorbing cell 20*c* due to the Helmholtz type resonance match each other, and thus, it is possible to cause the sound absorbing cell 20*a* and the sound absorbing cell 20*c* to interact to each other in the soundproof structure 10*f* of the present embodiment. As a result, for example, it can be seen that it is possible to obtain the absorbance of the sound which is much greater than 50% even though the frame sizes of the sound absorbing cell 20 are less than 1/10 of the wavelength of the sound waves. In the soundproof structure 10 of the present embodiment, the transmitted waves cancel each other in a region sandwiched between the first resonance frequencies, and thus, it is possible to increase a transmission loss.

Third Embodiment

Figure 20:
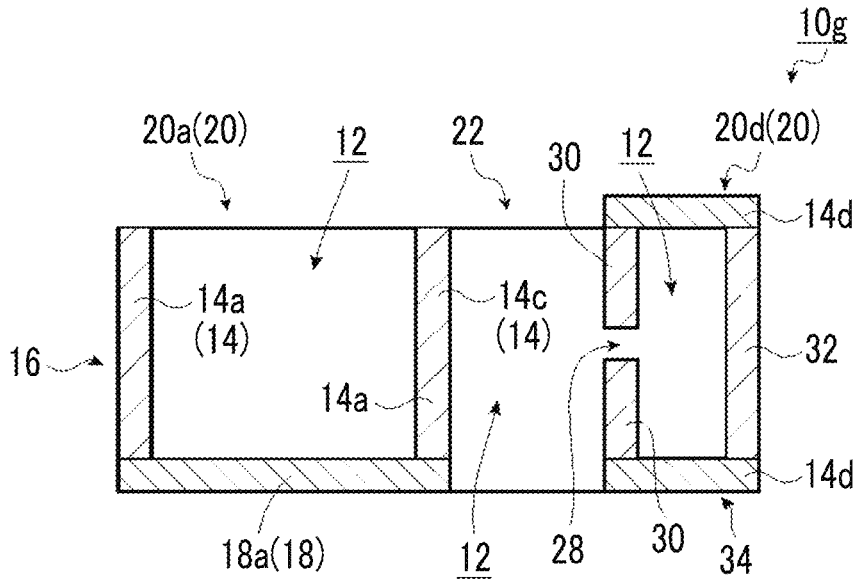
FIG. 20 is a schematic cross-sectional view of an example of a soundproof structure according to another embodiment of the present invention.

FIG. 20 is a schematic cross-sectional view showing an example of a soundproof structure according to a third embodiment of the present invention.

The soundproof structure 10*g* of the third embodiment shown in FIG. 20 is a structure using the second sound absorbing cell which is a Helmholtz resonator instead of the second sound absorbing cell 20*b* of the soundproof structure 10*b* of the first embodiment shown in FIG. 7, and has the same configuration as that of the first embodiment except for the second sound absorbing cell. The same constituent elements will be assigned the same references, and the description thereof will be omitted. In this case, the soundproof structure of the third embodiment is different from the soundproof structure of the first embodiment in that a resonance hole of the Helmholtz resonator of the second sound absorbing cell is perforated as the through-hole, as the resonance hole, in the perforated plate vertically arranged on a film surface of the film 18*a* of the first sound absorbing cell 20*a* and this perforated plate constitutes the frame of the opening cell 22. That is, in the second sound absorbing cell, the Helmholtz resonator is transversely arranged such that the resonance holes face the opening cell 22.

The soundproof structure 10*g* of the present embodiment is a structure in which the first sound absorbing cell 20*a*, the opening cell 22, and the second sound absorbing cell 20*d* are combined.

Here, the first sound absorbing cell 20*a* and the second sound absorbing cell 20*d* function as the first resonant type sound absorbing cell and the second resonant type sound absorbing cell of the present invention, respectively. A first resonance frequency of the first sound absorbing cell 20*a* and a higher-order (preferably, second) resonance frequency of the second sound absorbing cell 20*d* match each other. Accordingly, similarly to the sound absorbing cell 20*a* and the sound absorbing cell 20*b*, the sound absorbing cell 20*a* and the sound absorbing cell 20*d* are described as the sound absorbing cells 20 in a case where it is not necessary to distinguish these cells from each other.

The second sound absorbing cell 20*d* includes a frame 14*d* having an opening 12, a perforated plate 30 which comprises a through-hole 28, is fixed around the opening 12 of the frame 14*d*, and covers one end portion of the opening 12, and a rear plate 32 which is fixed around the opening 12 of the frame 14*d* and covers the other end portion of the opening 12. In the second sound absorbing cell 20*d* of the present invention, the frame 14*d* fixing the perforated plate 30 comprising the through-hole 28 and the rear plate 32 covering the other end portion of the opening 12 of the frame 14*d* constitute a housing 34 which fixes the perforated plate 30 and forms a closed space in a rear surface of the perforated plate 30. That is, the sound absorbing cell 20*d* is a Helmholtz soundproof cell that absorbs the sound by having a closed space volume (cavity) in the perforated plate 30 in which the through-hole 28 as the resonance hole is opened or the rear surface of the film, causing the cavity to be communicatively connected to outside air through the resonance hole, and causing the sound absorbing action due to the Helmholtz resonance.

The second sound absorbing cell 20*d* shown in FIG. 20 has the through-hole 28 in the perforated plate 30 fixed to the one end portion of the opening 12 of the frame 14*d*, and forms a space formed in the rear surface of the second sound absorbing cell by the frame 14*d* and the rear plate 32 except for the through-hole 28 of the perforated plate 30, as a closed space.

Since the frame 14*d* has the same configuration as those of the frames 14*a*, 14*b*, and 14*c* of the sound absorbing cells 20*a* and 20*b*, the opening cell 22, and the sound absorbing cell 20*c* of the soundproof structures 10 and 10*e* shown in FIGS. 1 and 13, the description thereof will be omitted.

Since the perforated plate 30 can cause the sound absorbing action due to the Helmholtz resonance by communicatively connecting the closed space of the rear surface with outside air by using the through-hole 28 as the resonance hole, there is no need for film vibration as in the films 18*b* of the sound absorbing cell 20*b* shown in FIG. 1. Accordingly, the perforated plate 30 may be a member having stiffness higher than or thicknesses thicker than the films 18*b* of the sound absorbing cell 20*b* shown in FIG. 1.

Thus, the same plate material as the aforementioned materials of the perforated plates 26 and the same plate material as the materials of the frames 14 such as a metal material such as aluminum or a resin material such as plastic can be used as the material of the perforated plate 30. However, as long as the sound absorption due to the film vibration is not caused, the material of the perforated plate 30 may be a member having stiffness lower than or thicknesses thinner than the materials of the perforated plates 26 and the materials of the frames 14.

Although the perforated plate 30 is used In the example shown in FIG. 20, the present invention is not limited thereto. As long as the sound absorption effect by the Helmholtz resonance can be caused, the perforated plate may be a film having a through-hole made of a film material. As the film used for the sound absorbing cell 20*d* used as the Helmholtz soundproof cell, the same film material as the film materials of the films 18*b* of the sound absorbing cell 20*b* shown in FIG. 1, which is the vibration film type soundproof cell described above, can be used as long as the sound absorption due to the film vibration is smaller than the sound absorption due to the Helmholtz resonance at the Helmholtz resonance frequency or as long as the sound absorption due to the film vibration is not caused. However, the film used for the sound absorbing cell 20*d* needs to be a film having stiffness higher than or a thickness thicker than the materials of the films 18*b* of the sound absorbing cell 20*b*.

In a case where the film having the through-hole is used as the sound absorbing cell 20*d* which is the Helmholtz soundproof cell, the resonance frequency of the Helmholtz resonance becomes the high frequency side and interferes with the film vibration in a case where the thickness of the film is small. For this reason, it is preferable to use the perforated plate 30 made of a plate material.

The method of fixing the perforated plate 30 or the film having the through-hole to the frame 14*d* is not particularly limited as long as the pseudo closed space can be formed in the rear surface of the perforated plate 30 or the film having the through-hole, and the same method as the above-described method of fixing the perforated plates 26 to the frame 14*b* and the above-described method of fixing the films 18 to the frames 14 may be used.

Here, the through-hole 28 perforated in the perforated plate 30 can also cause an attraction action due to the same Helmholtz resonance, and the through-hole 28 perforated in the perforated plate 30 may have the same configuration as the through-holes 24 perforated in the perforated plates 26 of the sound absorbing cell 20*c* shown in FIGS. 13 and 18.

In the present embodiment, since the through-hole 28 is perforated in the perforated plate 30 arranged in the opening cell 22 perpendicular to the film surface of the film 18*a* of the first sound absorbing cell 20*a*, the through-hole is formed in an inner wall surface of the opening cell 22. That is, although the sound absorbing cell 20*d* is arranged sideways such that the frame 14*d* is transversely arranged perpendicularly to the frame 14*a* and the through-hole 28 is formed in the inner wall surface of the opening cell 22, the present invention is not limited thereto. The sound absorbing cell 20*d* may be arranged such that the perforated plate 30 in which the through-hole 28 is formed is parallel with the film surface of the film 18*a* of the first sound absorbing cell 20*a*, and may be arranged in another position.

The rear plate 32 is a plate-shaped member which faces the perforated plate 30 and is attached to the other end portion of the opening 12 of the frames 14 in order to form the space formed in the rear surface of the perforated plate 30 by the frame 14*d*, as a closed space. Although such a plate-shaped member is not particularly limited as long as a closed space can be formed on the rear surface of the perforated plate 30, it is preferable to use a plate-shaped member made of a material having higher stiffness, similarly to the perforated plate 26. For example, as a material of the rear plate 32, it is possible to use the same material as the materials of the perforated plates 26 and the materials of the frames 14 described above. The method of fixing the rear plate 32 to the frame 14*d* is not particularly limited as long as a closed space can be formed in the rear surface of the perforated plate 30, and the same method as the method of fixing the perforated plates 26 to the frame 14*c* may be used.

Since the rear plate 32 is a plate-shaped member for forming the space formed in the rear surface of the perforated plate 30 by the frame 14*d* as a closed space, the rear plate may be integrated with the frame 14*d* or may be integrally formed by using the same material.

As described above, the soundproof structure 10*g* according to the embodiment of the present invention comprises the first sound absorbing cell 20*a*, the opening cell 22, and the second sound absorbing cell 20*d*. However, the first resonance frequency of the first sound absorbing cell 20*a* and the higher-order resonance frequency of the second sound absorbing cell 20*d* match each other, and thus, the maximum absorbance of the sound is demonstrated at the absorption peak frequency. For example, as will be described below, the soundproof structure 10*e* in which the first sound absorbing cell 20*a*, the opening cell 22, and the second sound absorbing cell 20*d* are arranged so as to be adjacent to each other as shown in FIG. 20 demonstrates the maximum absorbance of the sound at a maximum absorption frequency of 1400 Hz with the soundproofing characteristics of Example 13 shown in FIG. 21. In other words, in the soundproof structure 10*g* of Example 13 has 1400 Hz which is the maximum absorption frequency as shown in FIG. 21.

Figure 21:
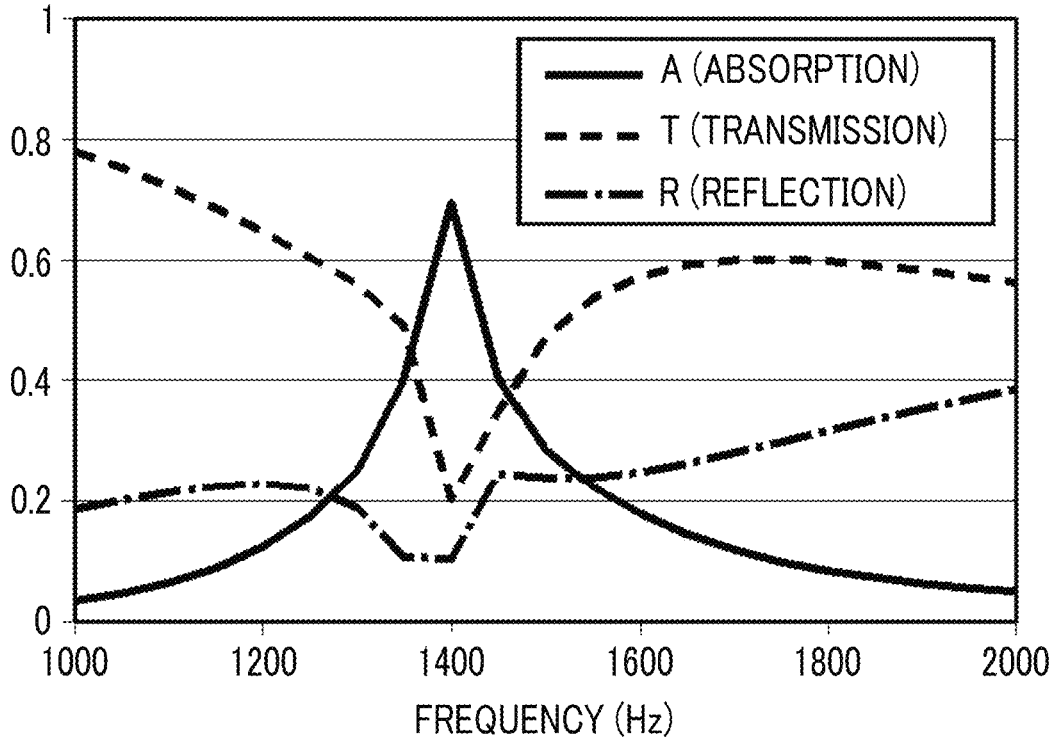
FIG. 21 is a graph showing soundproofing characteristics of Example 13 of the soundproof structure shown in FIG. 20.

As shown in FIG. 21, even though the soundproof structure 10*g* using the second sound absorbing cell 20*d* having a transverse Helmholtz structure in which the through-hole 28 as the Helmholtz resonance hole is transversely formed instead of the soundproof structure 10 using the second sound absorbing cell 20*b* having a two-layer film structure using the two layers of films 18*b* shown in FIGS. 1 and 7 or the soundproof structure 10*e* using the second sound absorbing cell 20*c* having the two-layer hole structure using the two layers of perforated plates 26 having the through-holes 24 shown in FIG. 13, it is possible to cause cancellation interference with the single-layer film 18*a*.

In the soundproof structure according to the embodiment of the present invention, it is possible to remain a high absorbance even though the opening cell 22 is provided so as to have a considerably large opening ratio (70% or less). It is possible to achieve an absorbance of more than 50% in the structure in which the size of the soundproof structure according to the embodiment of the present invention is sufficiently smaller than the wavelength as an absorbing target. It is possible to manufacture the soundproof structure which achieves both a high opening ratio and high absorption which are not known in the related art and are not able to be achieved in the related art with a relatively simple structure using the film vibration and the absorption using the through-hole. In the related art, since the sound absorption due to the single vibration or friction has been focused on and the interaction thereof and the orientation of the mode itself have not been focused, it is considered that it is not possible to conceive of distinguishing and precisely combining the resonant modes as in the present invention.

The soundproof structure according to the embodiment of the present invention is a technology for strongly absorbing any frequency of low to intermediate frequencies within the audible range, and does not need to add an extra structure such as the weight. Since the soundproof structure is the frame-perforated plate structure and/or the frame-film structure including only the frame and the film as the simplest configuration, the soundproof structure has excellent manufacturing suitability and advantages from the viewpoint of cost.

Since the technology for performing soundproofing (sound insulation) or the absorption of the sound (sound absorption) by the combination of the two kinds of sound absorbing cells and the opening cell is used, the soundproof structure according to the embodiment of the present invention can be adopted to various soundproofing or sound absorption technologies and can has versatility as compared to the related art in which the soundproofing or sound absorption effect is caused by means within one unit cell.

In the soundproof structure according to the embodiment of the present invention, since the soundproofing effect can be determined by the hardness, density, and/or thickness of the film among the physical properties of the film and does not need to depend on other physical properties, and/or since the soundproofing effect can be determined depending on the physical properties and dimensions of the frame, the combinations of various other excellent physical properties such as flame retardancy, high transmittance, biocompatibility, heat insulation, and radio wave transmittance can be used. For example, as for the radio wave transmittance, a radio wave transmittance is secured by combination of a frame material having no electric conductivity such as acryl and a dielectric film. Radio waves can be shielded by covering all the surfaces with a frame material having high electric conductivity such as aluminum or a metal film.

Hereinafter, the physical properties or characteristics of a structural member that can be combined with a soundproof member having the soundproof structure according to the embodiment of the present invention will be described.

[Flame Retardancy]

In the case of using a soundproof member having the soundproof structure according to the embodiment of the present invention as a soundproof material in a building or a device, flame retardancy is required.

Therefore, the film is preferably flame retardancy. As the film, for example, Lumirror (registered trademark) nonhalogen flame-retardant type ZV series (manufactured by Toray Industries) that is a flame-retardant PET film, Teijin Tetoron (registered trademark) UF (manufactured by Teijin), and/or Dialamy (registered trademark) (manufactured by Mitsubishi Plastics) that is a flame-retardant polyester film may be used.

The frame is also preferably a flame-retardant material. A metal such as aluminum, an inorganic material such as ceramic, a glass material, flame-retardant polycarbonate (for example, PCMUPY 610 (manufactured by Takiron)), and/or flame-retardant plastics such as flame-retardant acrylic (for example, Acrylite (registered trademark) FR1 (manufactured by Mitsubishi Rayon)) can be mentioned.

As a method of fixing the film to the frame, a bonding method using a flame-retardant adhesive (Three Bond 1537 series (manufactured by Three Bond)) or solder or a mechanical fixing method, such as interposing a film between two frames so as to be fixed therebetween, is preferable.

[Heat Resistance]

There is a concern that the soundproofing characteristics may be changed due to the expansion and contraction of the structural member of the soundproof structure according to the embodiment of the present invention due to an environmental temperature change. Therefore, the material forming the structural member is preferably a heat resistant material, particularly a material having low heat shrinkage.

As the film, for example, Teij in Tetoron (registered trademark) film SLA (manufactured by Teijin DuPont), PEN film Teonex (registered trademark) (manufactured by Teijin DuPont), and/or Lumirror (registered trademark) off-anneal low shrinkage type (manufactured by Toray) are preferably used. In general, it is preferable to use a metal film, such as aluminum having a smaller thermal expansion factor than a plastic material.

As the frame, it is preferable to use heat resistant plastics, such as polyimide resin (TECASINT 4111 (manufactured by Enzinger Japan)) and/or glass fiber reinforced resin (TECAPEEK GF 30 (manufactured by Enzinger Japan)) and/or to use a metal such as aluminum, an inorganic material such as ceramic, or a glass material.

As the adhesive, it is preferable to use a heat resistant adhesive (TB 3732 (Three Bond), super heat resistant one component shrinkable RTV silicone adhesive sealing material (manufactured by Momentive Performance Materials Japan) and/or heat resistant inorganic adhesive Aron Ceramic (registered trademark) (manufactured by Toagosei)). In the case of applying these adhesives to a film or a frame, it is preferable to set the thickness to 1 μm or less so that the amount of expansion and contraction can be reduced.

[Weather Resistance and Light Resistance]

In a case where the soundproof member having the soundproof structure according to the embodiment of the present invention is arranged outdoors or in a place where light is incident, the weather resistance of the structural member becomes a problem.

Therefore, as the film, it is preferable to use a weather-resistant film, such as a special polyolefin film (ARTPLY (registered trademark) (manufactured by Mitsubishi Plastics)), an acrylic resin film (ACRYPRENE (manufactured by Mitsubishi Rayon)), and/or Scotch Calfilm (trademark) (manufactured by 3M).

As a frame material, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select a film, a frame, and an adhesive having high moisture resistance. Regarding water absorption and chemical resistance, it is preferable to appropriately select an appropriate film, frame, and adhesive.

[Dust]

During long-term use, dust may adhere to the film surface to affect the soundproofing characteristics of the soundproof structure according to the embodiment of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK) and/or NCF (Nagaoka Sangyou)) so that the film is not charged, it is possible to prevent adhesion of dust due to charging. It is also possible to suppress the adhesion of dust by using a fluororesin film (Dynoch Film (trademark) (manufactured by 3M)), and/or a hydrophilic film (Miraclain (manufactured by Lifegard Co.)), RIVEX (manufactured by Riken Technology Inc.) and/or SH2CLHF (manufactured by 3M)). By using a photocatalytic film (Raceline (manufactured by Kimoto)), contamination of the film can also be prevented. A similar effect can also be obtained by applying a spray having the conductivity, hydrophilic property and/or photocatalytic property and/or a spray containing a fluorine compound to the film.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

As a method of removing adhering dust, it is possible to remove dust by emitting sound having the resonance frequency of a film and strongly vibrating the film. The same effect can be obtained even in a case where a blower or wiping is used.

[Wind Pressure]

The film is exposed to strong wind, and thus, the film is pressed. As a result, there is a possibility that the resonance frequency will be changed. Thus, nonwoven fabric, urethane, and/or a film is covered on the film, and thus, it is possible to suppress the influence of the wind.

The soundproof structure according to the embodiment of the present invention is basically configured as described above.

The soundproof structure according to the embodiment of the present invention can be used as the following soundproof members.

For example, as soundproof members having the soundproof structure according to the embodiment of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening part (soundproof member installed in the window of a room to prevent noise from indoor or outdoor); a soundproof member for ceiling (soundproof member installed on the ceiling of a room to control the sound in the room); a soundproof member for floor (soundproof member installed on the floor to control the sound in the room); a soundproof member for internal opening part (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for covering construction site to prevent leakage of a lot of noise around the construction site); and a soundproof member for tunnel (soundproof member installed in a tunnel to prevent noise leaking to the inside and outside the tunnel).

EXAMPLES

The soundproof structure according to the embodiment of the present invention will be described in detail by way of examples.

Sound insulation characteristics of the soundproof structure according to the embodiment of the present invention were analyzed. Hereinafter, Examples 1 to 13 will be described.

Example 1

As shown in FIG. 1, the first sound absorbing cell 20*a* (cell A) was manufactured by manufacturing the frame 14*a* having the opening 12 of 20 mm square and fixing and bonding a peripheral portion thereof to the frame 14*a* by using a polyethylene terephthalate (PET) film (manufactured by Toray Industries, Inc., Lumirror) having 188 μm as the film 18*a*. A depth thickness (frame thickness Lt) of the frame 14*a* is 15 mm, and the PET film is fixed to only one side in the cell A. A thickness (frame width Lw) of the frame portion of the frame 14*a* was 0.5 mm.

Similarly to the frame 14*a*, the first sound absorbing cell 20*b* (cell B) was manufactured by manufacturing the frame 14*b* which has the opening 12 of 20 mm square and has the same thickness and fixing and bonding a peripheral portion thereof to both ends of the frame 14*b* and the same thickness by using a PET film (manufactured by Toray Industries, Inc., Lumirror) having 100 μm as the film 18*b*. That is, a distance between the PET films is 15 mm.

The soundproof structure of Example 1 which is the soundproof structure 10 according to the embodiment of the present invention was manufactured by combining the cell A and the cell B and further combining the opening cell 22 which has the opening 12 of 20 mm square as the opening part of the present invention and the opened frame 14*c* to which the film 18 is not attached. At this time, the opening ratio was 28% with consideration for the frame thickness (frame width Lw).

The acoustic characteristics were measured by a transfer function method using four microphones in a self-made aluminum acoustic tube. This method is based on "ASTM E2611-09: Standard Test Method for Measurement of Normal Incidence Sound Transmission of Acoustical Materials Based on the Transfer Matrix Method". As the acoustic tube, for example, an acoustic tube based on the same measurement principle as WinZac manufactured by Nippon Sound Engineering Co., Ltd. was used. It is possible to measure the sound transmission loss in a wide spectral band using this method. The soundproof structure of Example 1 was arranged in a measurement portion of the acoustic tube, and the sound transmission loss was measured in a range of 10 Hz to 4000 Hz. In this measurement range, multiple combinations of diameters of the acoustic tube or distances between the microphones are measured.

In general, as the distance between the microphones becomes large, measurement noise becomes low at the low frequency. Meanwhile, as the distance between the microphones becomes longer than wavelength/2 on the high frequency side, it is not possible to perform the measurement. Thus, the measurement was performed multiple number of times while changing the distance between the microphones. The acoustic tube is thick, and thus, it is possible to perform the measurement due to the influence of the higher-order mode on the high frequency side. Accordingly, the diameter of the acoustic tube was also measured by using multiple kinds of diameters.

The acoustic tube was appropriately selected according to the size of the soundproof structure 10 (all the three cells) of Example 1 so as to include the size of all the three cells, acoustic characteristics, that is, acoustic transmittance (T) and reflectance (R) were measured by using the transfer function method, and absorbance (A) was obtained (A=1−T−R).

The obtained absorbance, transmittance, and reflectance are shown in FIG. 4. The opening ratio, absorption peak frequency, and peak absorbance of Example 1 are shown in Table 2.

It can be seen from FIG. 4 and Table 2 that the absorbance greatly exceeds 50% and an absorbance of 79% is obtained around 1420 Hz.

TABLE 2

| | First sound absorbing cell | Second sound absorbing cell | Opening ratio (%) | Absorption peak frequency (Hz) | Peak absorbance (%) |
|---|---|---|---|---|---|
| Example 1 | PET 188 μm | Two-layer PET 100 μm | 28 | 1420 | 79 |
| Comparative Example 1 | PET 188 μm | — | 28 | 1400 | 40 |
| Comparative Example 2 | — | Two-layer PET 100 μm | 28 | 1440 | 49 |
| Reference Example 1 | PET 188 μm | Two-layer PET 100 μm | — | 1420 | 87 |

TABLE 2-continued

| | First sound absorbing cell | Second sound absorbing cell | Opening ratio (%) | Absorption peak frequency (Hz) | Peak absorbance (%) |
|---|---|---|---|---|---|
| Example 2 | PET 188 μm | Two-layer PET 100 μm | 16 | 1420 | 84 |
| Example 3 | PET 188 μm | Two-layer PET 100 μm | 36 | 1420 | 76 |
| Example 4 | PET 188 μm | Two-layer PET 100 μm | 42 | 1420 | 73 |
| Example 5 | PET 188 μm | Two-layer PET 100 μm | 47 | 1420 | 70 |
| Example 6 | PET 188 μm | Two-layer PET 100 μm | 51 | 1420 | 66 |
| Example 7 | PET 188 μm | Two-layer PET 100 μm | 55 | 1420 | 61 |
| Example 8 | PET 188 μm | Two-layer PET 100 μm | 58 | 1420 | 58 |
| Example 9 | PET 188 μm | Two-layer PET 100 μm | 60 | 1420 | 56 |
| Example 10 | PET 188 μm | Two-layer PET 100 μm | 62 | 1420 | 54 |
| Comparative Example 3 | — | Two-layer PET 100 μm | 55 | 1440 | 42 |
| Example 11 | PET 188 μm | Two layers of plates with hole | 28 | 1450 | 70 |
| Example 12 | PET 188 μm | Two layers of plates with hole | 42 | 1440 | 64 |
| Example 13 | PET 188 μm | Transverse plate structure with hole | 36 | 1400 | 70 |

Comparative Example 1

The measurement was performed by using only the cell A and the opening part (opening cell 22). The opening ratio of the opening part was adjusted so as to have 28%.

Comparative Example 2

The measurement was performed by using only the cell B and the opening part (opening cell 22). The opening ratio of the opening part was adjusted so as to have 28%. The absorbances of Comparative Examples 1 and 2 were compared with the absorbance of Example 1. The result is shown in FIG. 5. The opening ratios, absorption peak frequencies, and peak absorbances of Comparative Examples 1 and 2 are shown in Table 2.

It can be seen from FIG. 5 and Table 2 that the maximum value of the absorbance does not exceed 50% both in Comparative Examples 1 and 2. Thus, assuming that there is no near-field interference of the sound, the absorbance is about 50% in the configuration in which the cell A and the cell B are merely arranged on the same plane as in Example 1.

In the configuration of the present invention, the cancellation due to the near-field interference has an important function for improving absorption. In order to verify the fact, acoustic calculation was performed by modeling the soundproof structure of Example 1 by using an acoustic module of multiphysics calculation software "COMSOL version 5.1" using a finite element method.

Since the system of this soundproof structure is an interaction system of the film vibration with sound waves in the air, analysis was performed by using a coupled analysis of sound and vibration. Specifically, design was performed by using an acoustic module of COMSOL version 5.0 which is analysis software of the finite element method. Initially, a first natural vibration frequency was obtained through natural vibration analysis. Subsequently, the acoustic characteristics at each frequency for the sound waves incident from a front surface were obtained by performing acoustic structure coupled analysis due to frequency sweep in a periodic structure boundary.

A shape or material of a sample was determined based on this design. The absorption peak frequency from an experimental result and the predicted frequency from simulation match each other.

A local velocity at an absorption peak frequency of 1420 Hz and a vector thereof in a mode corresponding to Example 1 are shown in FIG. 3. Arrows represent relative directions of local velocities, and lengths correspond to logarithms of the local velocities. It can be seen that the local velocities move around due to the interference of the waves between one-layer film of the cell A and the two layers of films of the cell B or between the transmitted sound of the opening part (the opening 12 of the opening cell 22) and the two layers of films of the cell B. As stated above, it is also clear from the simulation that the interference is caused between the adjacent cells and the transmitted sound components cancel each other.

Reference Example 1

A structure in which the cell A and the cell B are merely combined and the opening part is not formed was manufactured. In this case, the opening ratio becomes zero. The opening ratio, absorption peak frequency, and peak absorbance of Reference Example 1 are shown in Table 2. It can be seen from Table 2 that the waves cancel each other due to the interference in Reference Example 1 as in Example 1 and an absorption of 87% at 1420 Hz is obtained.

Examples 2 to 10, Comparative Example 3

In Example 1, a structure in which the opening ratio is changed by adjusting the size of the opening part (the opening 12 of the opening cell 22) was manufactured. Although the opening 12 of the frame 14*c* of 20 mm square was used as the opening part in Example 1, one side of the opening part (the opening 12 of the opening cell 22) is fixed as 20 mm and the other side thereof is changed to 10 mm to 100 mm for every 10 mm (20 mm is Example 1, 10 mm is Example 2, 30 mm is Example 3, size of N×10 mm (N is an integer of 4 to 9) is Example N, and 100 mm is Example 10).

A structure in which only the cell B used in Comparative Example 2 and the opening part are provided was manufactured as Comparative Example 3.

The opening ratios corresponding to the sizes of the opening parts of Examples 1 to 10, Comparative Examples 1 to 3, and Reference Example 1 are shown in Table 2. The opening ratios were adjusted to 16% to 62% in Examples 1 to 10, were adjusted to 28% in Comparative Examples 1 and 2 as in Example 1, and were adjusted to 55% in Comparative Example 3.

In Examples 1 to 10 and Reference Example 1, the absorption peak frequencies are 1420 Hz at all the sizes of the openings 12. The peak absorbances of Examples 1 to 10, Comparative Examples 1 to 3, and Reference Example 1 are shown in Table 2. It can be seen in Examples 1 to 10 that the opening part (opening 12) becomes large and the peak absorbance becomes low as the opening ratio becomes high, whereas absorbances of 50% or more are obtained and a high absorbance of 61% is obtained even in a case where the opening ratio is increased to 55%. In contrast, it can be seen in Comparative Examples 1 to 3 that the peak absorbances are respectively 40%, 49%, and 42% which are less than 50% and do not exceed 50% and the absorbances are lower than in the composite soundproof structure according to the embodiment of the present invention.

The relationship between the opening ratios, the distances between the two cells, and the peak absorbances in Examples 1 to 10 in which the sizes of the opening parts are changed are shown in FIGS. 8A and 8B. The changes in peak absorbances were checked. The peak absorbances in the case of the same opening ratios and the same distances between the two cells as those in Examples 1 to 10 by changing the size of the opening 12 of the opening cell 22 in the soundproof structure 10*b* shown in FIG. 7 to the sizes of Examples 1 to 10 are shown in FIGS. 8A and 8B. The changes in peak absorbances were checked. The soundproof structure 10*b* shown in FIG. 7 is the structure in which the same first sound absorbing cell 20*a*, the second sound absorbing cell 20*b* and the opening cell 22 as those in Examples 1 to 10 are used and the opening cell 22 is arranged between the first sound absorbing cell 20*a* and the second sound absorbing cell 20*b*.

As can be clear from the results shown in FIGS. 8A and 8B, in the soundproof structure 10 in which the opening part is present at the end portion, the opening ratio is about 20%, the absorbance exceeds 80%, and the absorbance exceeds 50% even in an opening ratio of about 60%. In contrast, in the soundproof structure 10*b* in which the opening part is present in the center, the absorbance is about 75% which is less than 80% even in an opening ratio of about 20%, and the absorbance is less than 30% even in an opening ratio of about 60%.

As shown in FIGS. 8A and 8B, as the opening ratio becomes high, the peak absorbance becomes low in both a case where the opening part (opening cell 22) is present at the end portion and a case where the opening part is present in the center. It can be seen that it is preferable that the first sound absorbing cell 20*a* and the second sound absorbing cell 20*b* which interact with the incident sound waves are arranged so as to be adjacent to each other.

Since the wavelength λ, is 0.243 m (24.3 cm) at a frequency of 1400 Hz, in a case where the distance between the two cells is λ/4, that is, 0.0608 m (6.08 cm) or more, the absorbance is decreased in both a case where the opening part is present at the end portion and a case where the opening part is present in the center. Accordingly, it can be seen from FIG. 8B that it is preferable that the distance between the two cells is λ/4 or less.

As can be clear from FIGS. 8A and 8B, in the soundproof structure according to the embodiment of the present invention, it is possible to realize high opening ratio and high absorption, and it is possible to realize large absorbance even in state in which the opening ratio is as high as about 60% or more.

In order to investigate behaviors on a lower opening ratio side in detail, in FIGS. 9 and 10, the absorption characteristics and transmission characteristics of the sound of the soundproof structure 10*b* in which the sizes of the first sound absorbing cell 20*a* having the square opening 12 of 20 mm square, the second sound absorbing cell 20*b*, and the opening 12 of the opening cell 22 as the opening part therebetween are changed were obtained.

As the size of the opening 12 of the opening cell 22, one side of the size of the rectangle of the opening 12 is 20 mm and the other side thereof is changed to 2 mm to 18 mm for every 2 mm. The absorption characteristics and transmission characteristics of the sound of the structure in which the opening part is not formed were obtained. The frame widths (Lw) of the frames 14 (14*a*, 14*b*, and 14*c*) are 1 mm.

As shown in FIG. 9, in the soundproof structure 10*b* according to the embodiment of the present invention, it can be seen that the absorbance is not almost changed even though the size of the opening 12 is changed and a high peak absorbance at the resonance frequency (absorption peak frequency of 1420 Hz) is not almost changed. That is, in the soundproof structure 10*b* according to the embodiment of the present invention, it can be seen that the peak absorbance becomes slightly small as the size of the opening part becomes large, is 70% or more, and is not almost changed.

As shown in FIG. 10, in the soundproof structure 10*b* according to the embodiment of the present invention, it can be seen that the transmittance of the sound is slightly decreased as the size of the opening part becomes small, but a valley (minimum) transmittance of the sound is ten-odd % or lower, is slightly decreased as the size of the opening part becomes smaller, and approaches 0%.

Example 11

As shown in FIG. 13, an acryl plate having a thickness of 2 mm was prepared, and was processed by a laser cutter so as to match the opening 12 of the frame 14 in Example 1. The circular through-hole 24 having a diameter of 2 mm was formed in a central portion of the acryl plate by a laser cutter. By doing this, two structures were manufactured.

The opening 12 of the frame 14 of 20 mm square was manufactured, and the depth thickness (frame thickness) of the frame 14 was 4.5 mm. The end portion of the perforated plate 26 constituted by the acryl plate in which the through-hole 24 are formed in both surfaces thereof is fixed to the edge part of the opening 12 on both sides of the frame 14. That is, the sound absorbing cell 20*c* (cell C) which is the structure in which the two perforated plates 26 comprising the through-holes 24 face each other with a distance of 4.5 mm was manufactured. As in Example 1, the sound absorbing cell 20*a* (cell A) which is the structure in which the single-layer film 18*a* having PET 188 μM is attached to the opening 12 of the adjacent frame 14*a* was manufactured.

The opening cell 22 was further provided in the adjacent portion in the structure in which the cell A and the cell C are adjacent to each other. The opening 12 had a square shape whose one side is 20 mm and the entire opening ratio was 30%. The acoustic tube of the soundproof structure 10*c* provided with the opening cell 22 was measured. The result is shown in Table 2 and FIG. 14.

From Table 2 and FIG. 14, the absorbance has a peak (maximum value), and is 70% at 1450 Hz.

Example 12

As in Example 11, the opening cell 22 was further provided in the adjacent portion adjacent in the structure in which the cell A and the cell C are adjacent to each other. The opening 12 of the opening cell 22 was a rectangular opening of 40 mm×20 mm, and the entire opening ratio was 47%. The acoustic tube of the soundproof structure 10*c* provided with the opening cell 22 was measured. The result is shown in Table 2 and FIG. 15.

The absorbance has a peak (maximum value), and is 64% at 1440 Hz.

It can be seen from FIG. 15 that a state in which the absorbance exceeds 50% is maintained even though the large opening 12 of the opening cell 22 is provided in the soundproof structure 10*b* in which the single-layer film 18*a* and the perforated plate 26 having the through-hole 24 are combined as compared to Examples 11 and 12.

In the soundproof structure 10*e* shown in FIG. 13, the acoustic tube was measured while changing the size of the opening part (the opening distance (mm) and the opening ratio of the opening 12 of the opening cell 22).

As in Example 11, the opening cell 22 including the openings 12 having different sizes was further provided in the portion in the structure in which the cell A and the cell C are adjacent to each other. One side of the opening 12 of the opening cell 22 was 20 mm, and the other side thereof was changed 5 mm to 100 mm for every 5 mm. In a case where the other side is 20 mm, the opening distance was 20 mm and the entire opening ratio was 30%. The acoustic tube of the soundproof structure 10*c* provided with this opening cell 22 was measured while changing the length of the other side. The result is shown in FIGS. 16 and 17.

As shown in FIGS. 16 and 17, it can be seen that the absorption characteristics during vibration due to the Helmholtz type resonance exceed 50% and the absorbance is maintained in a high state even though the opening part becomes large by further adding the through-hole 24*a* (or 24*b*) to the large opening 12 of the opening cell 22.

Example 13

As shown in FIG. 20, the acryl plate having the through-hole 28 having the diameter of 2 mm which was used in Example 11 was prepared as the perforated plate 30, and the opening 12 of the frame 14*d* whose one side is 20 mm was attached to the perforated plate. The soundproof structure 10*f* in which a rear surface thickness is 5 mm and the rear surface is closed by the rear plate 32 constituted by the acryl plate having no through-hole was manufactured. The soundproof structure 10*f* functions a so-called Helmholtz resonant structure in which the closed space is present behind the through-hole. This cell is a cell D.

The cell A and the cell D are combined and arranged. At this time, the cell D is arranged such that the rear plate 32 is provided on the wall, and is arranged such that the perforated plate 30 is parallel to the traveling direction of the sound within the acoustic tube. A distance from the cell A was 12 mm, and the acoustic tube of the combination thereof was measured. The opening ratio at this time is 39%. The result is shown in Table 2 and FIG. 21.

As shown in FIG. 21, the absorbance has a maximum value, and is 69%. An absorbance of 50% or more appears even in such a structure.

As stated above, in a case where the resonance of the single-layer film (cell A) and the resonance of another structure are combined, an absorption of 50% or more was obtained in an extremely thin structure. The absorption due to this resonance can function even though the large opening of the opening cell is presented.

Since the phase change in a case where the sound waves pass through single-layer film and the phase change in a case where the sound waves pass through the multiple-layer or transverse resonance structure cancel each other, it can be seen that a mechanism in which the transmitted waves of the resonances cancel each other, and the absorption is increased is achieved.

From the above, the effect of the soundproof structure according to the embodiment of the present invention is obvious.

While the soundproof structure according to the embodiment of the present invention has been described in detail with reference to various embodiments and examples, the present invention is not limited to these embodiments and examples, and various improvements or modifications may be made without departing from the scope and spirit of the present invention.

The soundproof structure according to the embodiment of the present invention can achieve an absorbance of more than 50%, preferably, close to 100% even in a compact, light, and thin structure which is much smaller than a wavelength. The soundproof structure according to the embodiment of the present invention can achieve the air permeability, heat conductivity, and high soundproofing effect by providing the passage of air. Thus, since the soundproof structure according to the embodiment of the present invention can be arranged in a fan duct for soundproof of devices, automobiles, and general households or can be used as a fan duct having a soundproof function. As a result, the soundproof structure is suitable for the purpose of the devices, automobiles, and general households.

EXPLANATION OF REFERENCES

10, 10*a*, 10*b*, 10*c*, 10*d*, 10*e*, 10*f*, 10*g*: soundproof structure
12: opening
14, 14*a*, 14*b*, 14*c*, 14*d*: frame
16: frame body
18, 18*a*, 18*b*, 18*b*1, 18*b*2: film
20, 20*a*, 20*b*, 20*c*, 20*d*: sound absorbing cell
22: opening cell
24, 24*a*, 24*b*, 28: through-hole
26, 26*a*, 26*b*, 30: perforated plate
32: rear plate
34: housing
Lt: frame thickness
Lw: frame width

What is claimed is:

1. A soundproof structure comprising:

two or more different kinds of resonant type sound absorbing cells; and an opening part, wherein the opening part is disposed in a position in contact with both two resonant type sound absorbing cells of the two or more different kinds of resonant type sound absorbing cells, or the two resonant type sound absorbing cells are adjacent to each other, and the opening part is disposed in a position adjacent to at least one of the two resonant type sound absorbing cells, and resonance frequencies of one kind of first resonant type sound absorbing cells and resonance frequencies of the other kind of second resonant type sound absorbing cells different from the first resonant type sound absorbing cells match each other.

2. The soundproof structure according to claim 1,
wherein the first resonant type sound absorbing cell includes a frame which has an opening and a film which is fixed around the opening of the frame and covers the opening.

3. The soundproof structure according to claim 2,
wherein the film is a single-layer film.

4. The soundproof structure according to claim 2,
wherein a first resonance frequency of the first resonant type sound absorbing cell including the film and the resonance frequency of the second resonant type sound absorbing cell match each other.

5. The soundproof structure according to claim 1,
wherein the opening part is an opening cell including a frame having an opening.

6. The soundproof structure according to claim 2,
wherein, assuming that a circle equivalent radius which is a size of the frame is am, a thickness of the film is tm, a Young's modulus of the film is EPa, and a density of the film is d kg/m$^3$, a parameter B expressed by Expression (1) is equal to or greater than 15.47 and is equal to or less than 235000.

$$B=t/a^2*\sqrt{(E/d)} \quad (1)$$

7. The soundproof structure according to claim 1,
wherein the opening part has a tubular shape, or is covered by a wall-shaped structure having a length with which movement of sound is restricted in all directions of the opening part.

8. The soundproof structure according to claim 1,
wherein, assuming that a wavelength at the resonance frequency is λ, the first resonant type sound absorbing cells that satisfy a condition in which a distance between the first resonant type sound absorbing cell and the second resonant type sound absorbing cell closest to the first resonant type sound absorbing cell is less than λ/4 occupy 60% or more of all of the first resonant type sound absorbing cells.

9. The soundproof structure according to claim 1,
wherein the second resonant type sound absorbing cell includes a frame which has an opening and at least two layers of films which are fixed around the opening of the frame and cover the opening.

10. The soundproof structure according to claim 9,
wherein the at least two layers of films are two layers of films which are fixed around both sides of the opening of the frame and cover the opening.

11. The soundproof structure according to claim 1,
wherein the second resonant type sound absorbing cell includes a frame having an opening and at least two layers of plates which include through-holes, respectively, and are fixed around the opening of the frame.

12. The soundproof structure according to claim 11,
wherein the at least two layers of plates are two layers of plates which respectively include the through-holes, are fixed around both sides of the opening of the frame, and cover the opening.

13. The soundproof structure according to claim 11,
wherein the opening part includes the through-holes of the at least two layers of plates.

14. The soundproof structure according to claim 11,
wherein the second resonant type sound absorbing cell is a structure which has the through-holes respectively formed in the two layers of plates which cover both sides of the opening and has a resonance similar to a Helmholtz resonance.

15. The soundproof structure according to claim 1,
wherein the opening part includes a space which is formed on an outside of the first resonant type sound absorbing cell and/or on an outside of the second resonant type sound absorbing cell.

16. The soundproof structure according to claim 15,
wherein the opening part includes a space formed between the first resonant type sound absorbing cell and the second resonant type sound absorbing cell.

17. The soundproof structure according to claim 15,
wherein the first resonant type sound absorbing cell and the second resonant type sound absorbing cell are arranged in positions adjacent to each other, and
the opening part includes a space which is formed on the outside of the first resonant type sound absorbing cell or on the outside of the second resonant type sound absorbing cell which is on a side opposite to a side on which the first resonant type sound absorbing cell and the second resonant type sound absorbing cell are adjacent to each other.

18. The soundproof structure according to claim 1,
wherein the second resonant type sound absorbing cell includes a single-layer plate which has a through-hole and a housing which fixes the plate and forms a closed space on a rear surface of the plate.

19. The soundproof structure according to claim 18,
wherein the second resonant type sound absorbing cell is a structure having a Helmholtz resonance.

20. The soundproof structure according to claim 18,
wherein the first resonant type sound absorbing cell and the second resonant type sound absorbing cell are provided side by side at an interval,
the through-hole of the plate of the second resonant type sound absorbing cell is formed in a position facing the first resonant type sound absorbing cell, and
the opening part includes a portion formed between the first resonant type sound absorbing cell and the second resonant type sound absorbing cell.

21. The soundproof structure according to claim 1,
wherein the first resonant type sound absorbing cell and the second resonant type sound absorbing cell are arranged in a duct, and
the opening part includes a space between the first resonant type sound absorbing cell, the second resonant type sound absorbing cell, and an inner wall of the duct.

22. The soundproof structure according to claim 1,
wherein the resonance frequencies matched in the first resonant type sound absorbing cell and the second resonant type sound absorbing cell are included in a range of 10 Hz to 100000 Hz.

23. The soundproof structure according to claim 1,
wherein a cell structure includes at least three frames each having an opening, and in the cell structure, at least one first frame of the three frames to which a film is attached functions as the first resonant type sound absorbing cell, at least one second frame to which a film or a plate is attached and which is different from the first frame functions as the second resonant type sound absorbing cell, and at least one third frame which is different from the first frame and the second frame functions as the opening part.

* * * * *